US006942567B2

(12) United States Patent
Baerlocher et al.

(10) Patent No.: US 6,942,567 B2
(45) Date of Patent: Sep. 13, 2005

(54) GAMING DEVICE HAVING AN OFFER AND ACCEPTANCE GAME WITH A PLAYER SELECTION FEATURE

(75) Inventors: Anthony J. Baerlocher, Reno, NV (US); Bayard S. Webb, Sparks, NV (US); Anna Sheila C. Parrucho, Reno, NV (US)

(73) Assignee: IGT, Reno, NV (US)

( * ) Notice: Subject to any disclaimer, the term of this patent is extended or adjusted under 35 U.S.C. 154(b) by 191 days.

(21) Appl. No.: 10/086,078

(22) Filed: Feb. 27, 2002

(65) Prior Publication Data

US 2003/0162578 A1 Aug. 28, 2003

(51) Int. Cl.[7] ..... A63F 9/24
(52) U.S. Cl. ..... 463/16; 463/25
(58) Field of Search ..... 273/139, 138.1, 273/138.2, 143 E; 463/16–22, 25, 26, 40–42, 137

(56) References Cited

U.S. PATENT DOCUMENTS

| | | | |
|---|---|---|---|
| 4,448,419 | A | 5/1984 | Telnaes |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,991,848 | A | 2/1991 | Greenwood et al. |
| 5,178,390 | A | 1/1993 | Okada |
| 5,205,555 | A | 4/1993 | Hamano |
| 5,342,047 | A | 8/1994 | Heidel et al. |
| 5,456,465 | A | 10/1995 | Durham |
| 5,524,888 | A | 6/1996 | Heidel |
| 5,536,016 | A | 7/1996 | Thompson |
| 5,542,669 | A | 8/1996 | Charron et al. |
| 5,560,603 | A | 10/1996 | Seelig et al. |
| 5,611,535 | A | 3/1997 | Tiberio |
| 5,711,525 | A | 1/1998 | Breeding |
| 5,769,716 | A | 6/1998 | Saffari et al. |
| 5,772,509 | A | 6/1998 | Weiss |
| 5,775,692 | A | 7/1998 | Watts et al. |
| 5,788,573 | A | 8/1998 | Baerlocher et al. |
| 5,823,874 | A | 10/1998 | Adams |
| 5,833,538 | A | 11/1998 | Weiss |
| 5,848,932 | A | 12/1998 | Adams |
| 5,851,148 | A | 12/1998 | Brune et al. |
| 5,873,781 | A | 2/1999 | Keane |
| 5,882,261 | A | 3/1999 | Adams |
| 5,902,184 | A | 5/1999 | Bennett et al. |
| 5,911,418 | A | 6/1999 | Adams |

(Continued)

FOREIGN PATENT DOCUMENTS

| | | |
|---|---|---|
| EP | 0874337 A1 | 10/1998 |
| EP | 0926645 A2 | 6/1999 |
| EP | 0944030 A2 | 9/1999 |
| EP | 0945837 A2 | 9/1999 |
| EP | 0981119 A2 | 2/2000 |
| EP | 0984408 A2 | 3/2000 |
| EP | 0984409 A2 | 3/2000 |
| WO | WO 9732285 | 9/1997 |
| WO | WO 00/12186 | 3/2000 |

OTHER PUBLICATIONS

Punch–a–Bunch/The Punch Board, [http://gscentral.net/punch.htm], pps 1–6.*

(Continued)

*Primary Examiner*—Mark Sager
(74) *Attorney, Agent, or Firm*—Bell, Boyd & Lloyd, LLC

(57) ABSTRACT

A gaming device having an offer and acceptance bonus game which enables the player to determine all of the offers made to the player prior to any of them being displayed to the player. An alternative embodiment enables the player to obtain modified offers during the play of the bonus game by providing the player with additional picks which correspond to additional or combined offers.

48 Claims, 21 Drawing Sheets

U.S. PATENT DOCUMENTS

| | | | | |
|---|---|---|---|---|
| 5,947,820 | A | 9/1999 | Morro et al. | |
| 5,951,397 | A | 9/1999 | Dickinson | |
| 5,964,463 | A | 10/1999 | Moore, Jr. | |
| 5,967,894 | A | 10/1999 | Kinoshita et al. | |
| 5,980,384 | A | 11/1999 | Barrie | |
| 5,984,781 | A | 11/1999 | Sunaga | |
| 5,997,400 | A | 12/1999 | Seelig et al. | |
| 5,997,401 | A | 12/1999 | Crawford | |
| 6,004,207 | A | 12/1999 | Wilson, Jr. et al. | |
| 6,015,346 | A | 1/2000 | Bennett | |
| 6,019,369 | A | 2/2000 | Nakagawa et al. | |
| 6,033,307 | A | 3/2000 | Vancura | |
| 6,056,642 | A | 5/2000 | Bennett | |
| 6,059,289 | A | 5/2000 | Vancura | |
| 6,059,658 | A | 5/2000 | Mangano et al. | |
| 6,062,980 | A | 5/2000 | Luciano | |
| 6,089,976 | A | 7/2000 | Schneider et al. | |
| 6,089,977 | A | 7/2000 | Bennett | |
| 6,089,978 | A | 7/2000 | Adams | |
| 6,093,102 | A | 7/2000 | Bennett | |
| 6,102,798 | A | 8/2000 | Bennett | |
| 6,120,031 | A | 9/2000 | Adams | |
| 6,126,541 | A | 10/2000 | Fuchs | |
| 6,126,542 | A | 10/2000 | Fier | |
| 6,142,873 | A | 11/2000 | Weiss et al. | |
| 6,142,874 | A | 11/2000 | Kodachi et al. | |
| 6,142,875 | A | 11/2000 | Kodachi et al. | |
| 6,146,273 | A | 11/2000 | Olsen | |
| 6,159,095 | A | 12/2000 | Frohm et al. | |
| 6,159,096 | A | 12/2000 | Yoseloff | |
| 6,159,097 | A | 12/2000 | Gura | |
| 6,159,098 | A | 12/2000 | Slomiany et al. | |
| 6,162,121 | A | 12/2000 | Morro et al. | |
| 6,168,520 | B1 | 1/2001 | Baerlocher et al. | |
| 6,168,523 | B1 | 1/2001 | Piechowiak et al. | |
| 6,173,955 | B1 | 1/2001 | Perrie et al. | |
| 6,174,233 | B1 | 1/2001 | Sunaga et al. | |
| 6,174,235 | B1 | 1/2001 | Walker et al. | |
| 6,190,254 | B1 | 2/2001 | Bennett | |
| 6,190,255 | B1 | 2/2001 | Thomas et al. | |
| 6,203,429 | B1 | 3/2001 | Demar et al. | |
| 6,210,279 | B1 | 4/2001 | Dickinson | |
| 6,213,876 | B1 | 4/2001 | Moore, Jr. | |
| 6,224,483 | B1 | 5/2001 | Mayeroff | |
| 6,231,442 | B1 | 5/2001 | Mayeroff | |
| 6,231,445 | B1 | 5/2001 | Acres | |
| 6,261,177 | B1 | 7/2001 | Bennett | |
| 6,302,790 | B1 | 10/2001 | Brossard | |
| 6,305,686 | B1 | 10/2001 | Perrie et al. | |
| 6,309,300 | B1 | 10/2001 | Glavich | |
| 6,328,649 | B1 | 12/2001 | Randall et al. | |
| 6,375,187 | B1 | 4/2002 | Baerlocher | |
| 6,398,218 | B1 | 6/2002 | Vancura | |
| 6,413,160 | B1 | 7/2002 | Vancura | |
| 6,435,511 | B1 | 8/2002 | Vancura et al. | |
| 6,506,118 | B1 * | 1/2003 | Baerlocher et al. | 463/25 |
| 6,514,141 | B1 | 2/2003 | Kaminkow et al. | |
| 2002/0187827 | A1 | 12/2002 | Blankstein | |

OTHER PUBLICATIONS

Addams Family Advertisement and Article written by IGT, Strictly Slots, published in 2000.

Adders and Ladders Advertisement written by Barcrest Ltd., published prior to 2000.

American Thunder Screen Shots written by IGT, published in 1998.

Big Bang Piggy Bankin Advertisement written by WMS Gaming, Inc., published prior to 2000.

Blackjack/Twenty–One Description written by Hoyle's Rules of Games, published in 1993.

Bonus Spin Red, White & Blue Advertisement written by IGT, published in 2000.

Bonus Times Article written by Strictly Slots, published in 2000.

By George written by IGT, published in 2002.

Caribbean Gold II Advertisement written by Aristocrat Incorporated, published in 1998.

Cash Box Advertisement & Article written by Anchor Games, Strictly Slots, published in 2000.

Chutes & Ladders Game Instructions written by Hasbro–Milton Bradley, published in 1999.

Description of Let's Make a Deal Television Show written by letsmakeadeal.com (2 pages), printed on Mar. 16, 2001.

Double Diamond Game Descriptions written by IGT printed on March 21, 2001.

Double Up Poker Game Description written by IGT Undated.

Easy Street Advertisements and Articles written by Casino Data Systems, published in 2000.

Elvis Advertisement written by IGT, published in 1999.

Empire Game Advertisement written by AC Coin, published in 1996.

Fire and Fortune Article written by Strictly Slots, published in 2001.

Fox "N" Hound Advertisement written by IGT, published in 2000.

In Between Game Description written by IGT, available prior to 2000.

Jackpot Party Advertisements and Articles written by WMS Gaming, Inc., published in 1998.

Keep Your Hat On Advertisement written by Aristocrat, published in 2001.

Let's Make a Deal written by geocities.com (10 pages), printed on Mar. 21, 2001.

Let's Make a Deal written by fortunecity.com (4 pages), printed on Mar. 21, 2001.

Let's Make a Deal written by Illinoislottery.com (1 page), printed on Mar. 21, 2001.

Let's Make a Deal geocities.com (2 pages), printed on Mar. 16, 2001.

Let's Make a Deal Advertisement written by Shuffle Master and IGT, published in 2001.

Let's Make a Deal Game Advertisement written by Bally Gaming Systems, published in 1999.

Little Green Men Advertisement and Article written by IGT, Strictly Slots, published in 2000.

MegaJackpots Advertisement written by IGT, published in 1998.

Money Grab Article written by Strictly Slots, published in Apr. 2001.

Money in the Bank Advertisement written by Strictly Slots Konami, published in 2001.

Monopoly Advertisements and Articles written by WMS Gaming, Inc., Strictly Slots, published in 1998, 1999, 2000.

Monopoly Party Train Article written by Strictly Slots, published in 2002.

Neon Nights written by IGT, published in 2000.

On the Money Article written by Strictly Slots, Casino Data Systems, published in Dec. 2000.

Polly & Roger Advertisement written by VLC, Inc., published in 2000.

Price is Right "Cliff Hangers" Description written by www-.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd., published in 1997.
Take Your Pick Article written by Strictly Slots, published in Mar. 2001.
Take Your Pick Advertisement written by IGT/Anchor Gaming, published in 1999.
Texas Tea Advertisement written by IGT, published in 2000.
The Deals of Let's Make a Deal written by fortunecity.com (2 pages), printed on Mar. 16, 2001.
The Official Let's Make a Deal Website written by Bally Gaming System Website, printed on Mar. 16, 2001.
Top Cat Advertisement written by WMS Gaming, Inc., published prior to 2000.
Top Dollar Game Advertisement written by IGT, published in 1998.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel Poker Article written by Strictly Slots (Anchor Games), published in Nov. 2000.
Winning Streak Website Description written by WMS Gaming Inc. (web site), printed on Mar. 21, 1001.
X Factor Advertisement and Website Page written by WMS Gaming, Inc., published in 1998.

* cited by examiner

GAMING DEVICE HAVING AN OFFER AND ACCEPTANCE GAME WITH A PLAYER SELECTION FEATURE

CROSS REFERENCE TO RELATED APPLICATIONS

This application is related to the following commonly-owned co-pending patent applications: "GAMING DEVICE HAVING SEPARATELY CHANGEABLE VALUE AND MODIFIER BONUS SCHEME," Ser. No. 09/626,045; "GAMING DEVICE HAVING A BONUS ROUND WITH MULTIPLE RANDOM AWARD GENERATION AND MULTIPLE RETURN/RISK SCENARIOS," Ser. No. 09/678,989; "GAMING DEVICE HAVING AN AWARD EXCHANGE BONUS ROUND AND METHOD FOR REVEALING AWARD EXCHANGE POSSIBILITIES," Ser. No. 09/689,510; "GAMING DEVICE HAVING GRADUATING AWARD EXCHANGE SEQUENCE WITH A TEASE CONSOLATION SEQUENCE AND AN INITIAL QUALIFYING SEQUENCE," Ser. No. 09/680,601; "GAMING DEVICE HAVING A DESTINATION PURSUIT BONUS SCHEME WITH ADVANCED AND SETBACK CONDITIONS," Ser. No. 09/686,409; "GAMING DEVICE HAVING VALUE SELECTION BONUS," Ser. No. 09/684,605; "GAMING DEVICE HAVING RISK EVALUATION BONUS ROUND," Ser. No. 09/688,434; "GAMING DEVICE HAVING AN IMPROVED OFFER/ACCEPTANCE BONUS SCHEME," Ser. No. 09/966,884; "GAMING DEVICE HAVING IMPROVED OFFER AND ACCEPTANCE BONUS SCHEME," Ser. No. 09/680,630; "GAMING DEVICE HAVING IMPROVED AWARD OFFER BONUS SCHEME," Ser. No. 09/682,368; "GAMING DEVICE HAVING OFFER AND ACCEPTANCE GAME WITH HIDDEN OFFER," Ser. No. 10/160,688; "GAMING DEVICE HAVING OFFER ACCEPTANCE GAME WITH TERMINATION LIMIT," Ser. No. 09/822,711; "GAMING DEVICE HAVING OFFER/ACCEPTANCE ADVANCE THRESHOLD AND LIMIT BONUS SCHEME," Ser. No. 09/838,014; "GAMING DEVICE HAVING IMPROVED OFFER AND ACCEPTANCE GAME WITH MASKED OFFERS," Ser. No. 10/086,014; "GAMING DEVICE HAVING AN OFFER AND ACCEPTANCE SELECTION BONUS SCHEME WITH A TERMINATOR AND AN ANTI-TERMINATOR," Ser. No. 09/945,082; "GAMING DEVICE HAVING AN AWARD OFFER AND TERMINATION BONUS SCHEME," Ser. No. 09/682,428; "GAMING DEVICE HAVING OFFER AND ACCEPTANCE GAME WITH A PLURALITY OF AWARD POOLS, A REVEAL FEATURE, AND A MODIFY FEATURE," Ser. No. 10/255,862; "GAMING DEVICE HAVING IMPROVED OFFER AND ACCEPTANCE BONUS SCHEME," Ser. No. 10/074,273; "GAMING DEVICE HAVING AN OFFER/ACCEPTANCE GAME WITH MULTI-OFFER SYMBOL," Ser. No. 10/245,387; "GAMING DEVICE HAVING AN OFFER/ACCEPTANCE GAME WHEREIN EACH OFFER IS BASED ON A PLURALITY OF INDEPENDENTLY GENERATED EVENTS," Ser. No. 10/244,134; "GAMING DEVICE HAVING A DESTINATION PURSUIT BONUS SCHEME WITH ADVANCED AND SETBACK CONDITIONS," Ser. No. 10/288,750; "GAMING DEVICE HAVING IMPROVED AWARD OFFER BONUS SCHEME," Ser. No. 10/290,800; "GAMING DEVICE HAVING VALUE SELECTION BONUS," Ser. No. 10/306,295; "GAMING DEVICE HAVING IMPROVED AWARD OFFER BONUS SCHEME," Ser. No. 10/318,752; and "GAMING DEVICE HAVING VALUE SELECTION BONUS," Ser. No. 10/354,514.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device, and more particularly to a gaming device having an offer and acceptance game with a player selection feature.

Gaming devices, such as slot machines, having primary and secondary or bonus games or schemes are well known. One well known bonus game provides a player with a series of award offers consisting of credits or dollars. The player may either accept each award offer or reject each award offer; however, the player must accept the final award offer. If the player accepts an award offer, the player keeps the award offered to the player. If the player rejects the award offer, the gaming device provides another award offer to the player except if the award offer is the final award offer. The award offers are randomly determined from a series of award offers of differing values.

Certain implementations of this type of bonus scheme for a gaming device have been implemented in gaming machines of various types. While this type of gaming device has achieved significant popularity in the gaming industry, after playing the game repeatedly, players may lose interest in the game. Accordingly, there is a need for gaming devices having new offer and acceptance games.

SUMMARY OF THE INVENTION

The present invention provides a gaming device having an offer and acceptance game with a player selection feature. In one embodiment of the present invention, the gaming device provides a plurality of player selectable selections and an offer from a plurality of offers randomly associated with each selection. The gaming device provides a plurality of player picks of the selections. The gaming device enables the player to pick one selection for each pick provided to the player. The gaming device does not initially reveal the offer associated with each selection picked by the player. After the player has picked a selection for each provided pick, the gaming device reveals the offer associated with the player's first picked selection. The gaming device enables the player to either accept or reject the first revealed offer. If the player accepts the first revealed offer, the player obtains the first revealed offer and the game terminates. If the player rejects the first revealed offer, the gaming device reveals the offer associated with the player's second picked selection. The gaming device enables the player to either accept or reject the second revealed offer. If the player accepts the second revealed offer, the player obtains the second revealed offer and the game terminates. If the player rejects the second revealed offer and the player has at least one non-revealed picked selection remaining, then the gaming device reveals the offer associated with the player's next picked selection. If the gaming device has revealed the offers associated with all the player picked selections, then the player obtains the last revealed offer and the game terminates.

It should thus be appreciated that the game terminates when the player either accepts a revealed offer or the gaming device has revealed the offers associated with all the player picked selections and the player obtains the last revealed offer. In one embodiment, after a revealed offer has been accepted, the gaming device reveals the offers associated with each non-revealed player picked selection. The game of the present invention therefore enables the player to determine all of the offers which the gaming device makes or potentially will make to the player. Additionally, because the player picks all of the selections first, the offers the gaming device may potentially offer to the player are determined at the onset of the game. Allowing the player to blindly select which offers will potentially be offered to the player, coupled with allowing the player to accept or reject each offer as it is revealed, provides increased entertainment and enjoyment to the player of the present invention.

In an alternative embodiment of the present invention, in addition to associating a plurality of offers with a plurality of selectable selections, the gaming device also associates a plurality of player picks with the plurality of selections. It should be appreciated that there are less player picks than selections, and thus not all selections are associated with a player pick. The game proceeds as described above with the gaming device enabling the player to pick one selection for each pick provided to the player. However, if the player picks a selection with an associated player pick, the gaming device reveals an additional player pick and enables the player to pick another selection. The offer associated with the additionally picked selection is combined with the offer associated with the original picked selection to form the player's modified offer.

In a further alternative embodiment of the present invention, the gaming device does not reveal any additional pick associated with the player picked selection until after the offer associated with the picked selection is revealed. In this embodiment, the gaming device provides a plurality of additional picks which are randomly associated with a plurality of selectable selections. It should be appreciated that each selection remains associated with an offer, and thus a plurality of selections are associated with both an offer and an additional pick. The game proceeds as described above, however, if the gaming device reveals both an offer and an additional pick associated with a player's picked selection, the gaming device enables the player to select an additional selection from the plurality of selections. The offer associated with the additional picked selection is combined with the offer associated with the original picked selection to form the player's modified offer.

In one alternative embodiment of the present invention, the gaming device provides a pre-game or method for enabling the player to determine the number of player picks of the selectable selections provided to the player. In one embodiment, the gaming device provides a plurality of masked symbols. A plurality of player picks of the selections are randomly associated with the plurality of masked symbols. The gaming device does not initially reveal if a player pick is associated with each masked symbol. The gaming device also provides a plurality of player choices of the masked symbols. The number of player choices is less than the number of masked symbols. In this embodiment, the player chooses a masked symbol for each provided player choice. The gaming device reveals if a player pick is associated with each chosen masked symbol. The player obtains the number of revealed player picks to pick selectable selections as described in the above embodiment. Thus, the number of player picks determines the maximum number of offers potentially made to and picked by the player. It should be appreciated that the number of player picks may be randomly determined, pre-determined, based on the bonus triggering event, based on the player's wager or otherwise suitably determined.

It is therefore an advantage of the present invention to provide a gaming device having an offer and acceptance game with a player selection feature.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
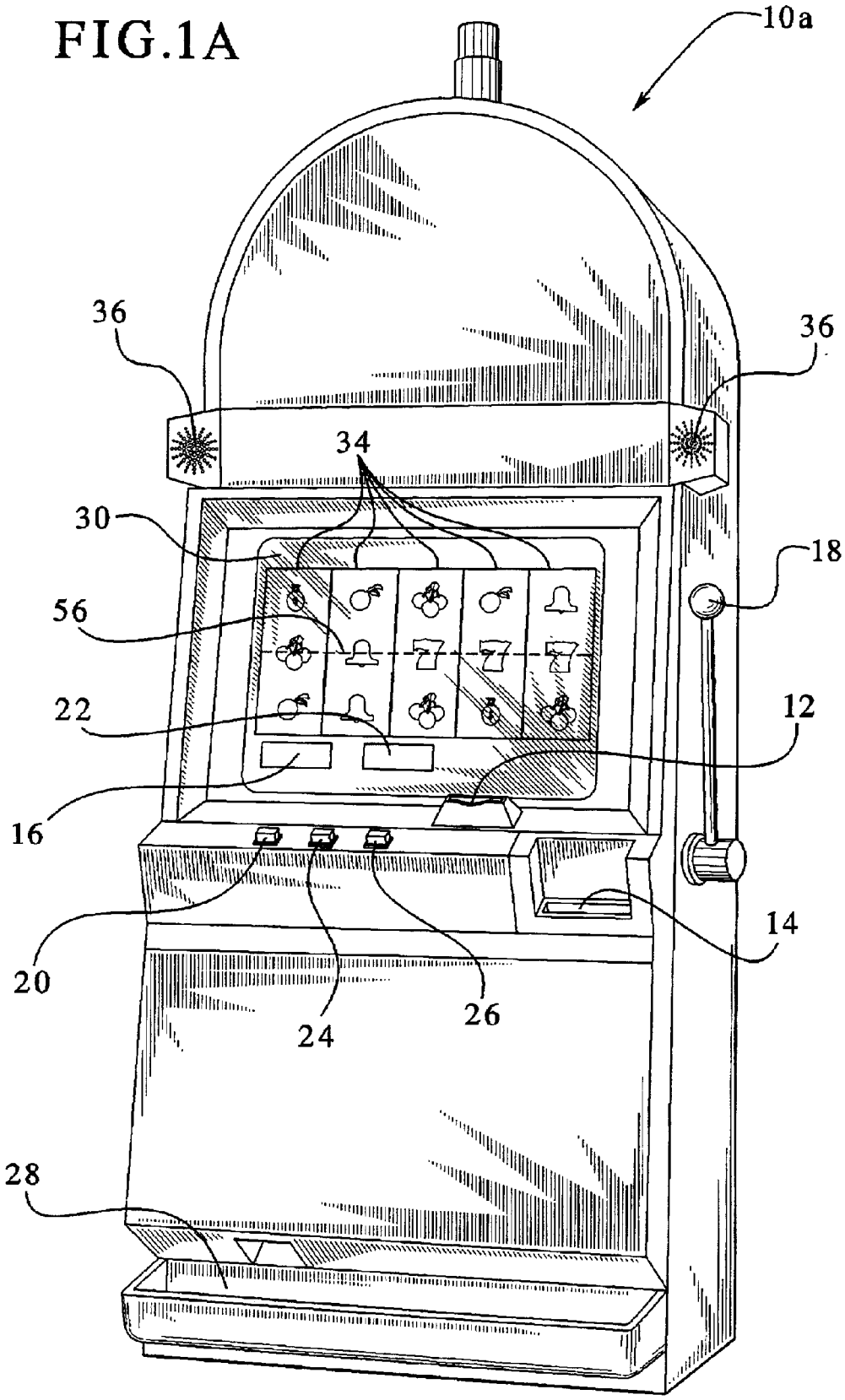
FIGS. 1A and 1B are perspective views of alternative embodiments of the gaming device of the present invention.
Figure 1B:
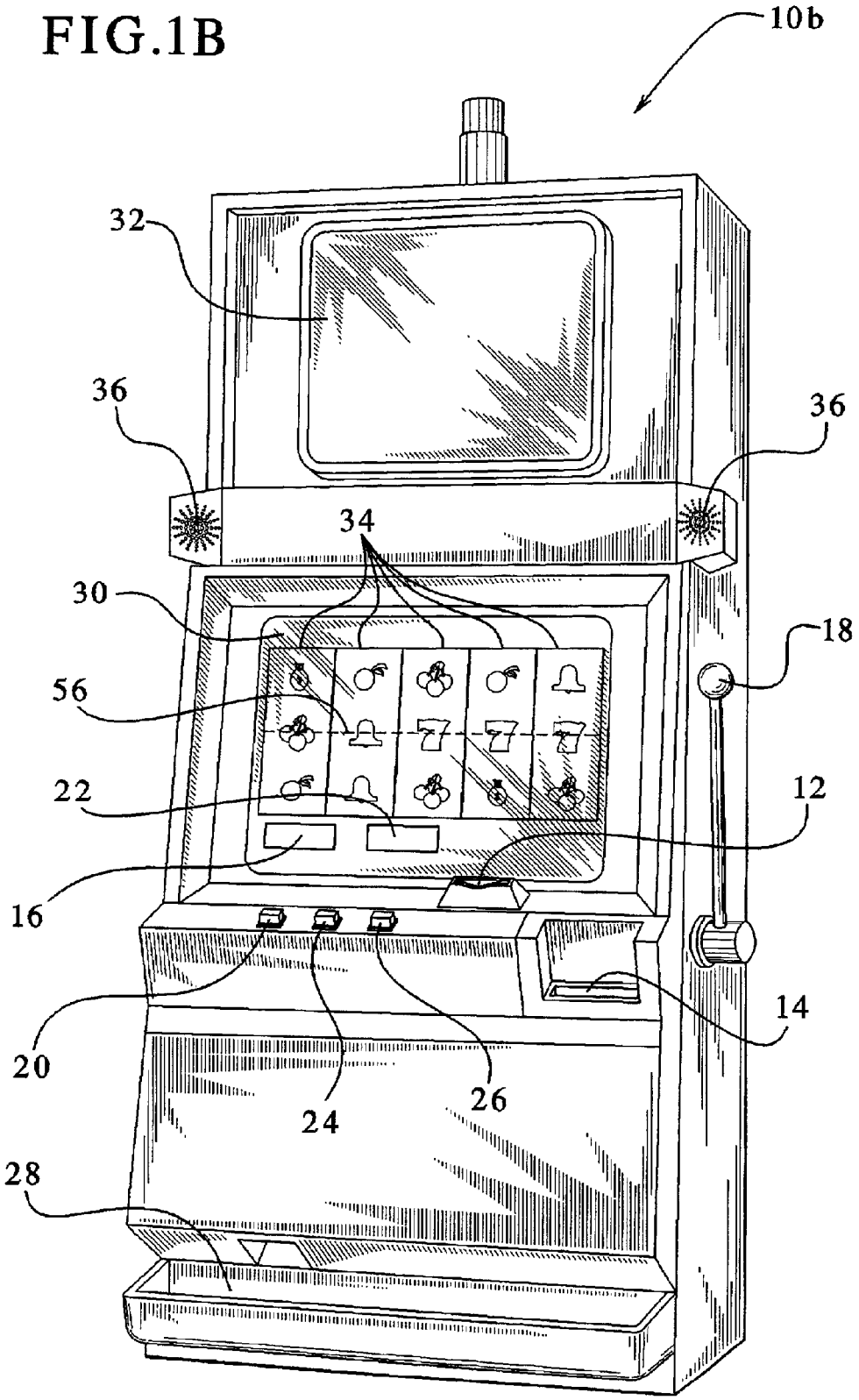

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is in one embodiment a slot machine having the controls, displays and features of a conventional slot machine. It is constructed so that a player can operate it while standing or sitting, and gaming device 10 is mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or blackjack or keno, any of their bonus triggering events and any of their bonus round games. The symbols and indicia used on and in gaming device 10 may be in mechanical, electrical, electronic or video form.

As illustrated in FIGS. 1A and 1B, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 or any other suitable wage or indicator such as a bet max button can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 in one embodiment displays a plurality of reels 34, such as three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
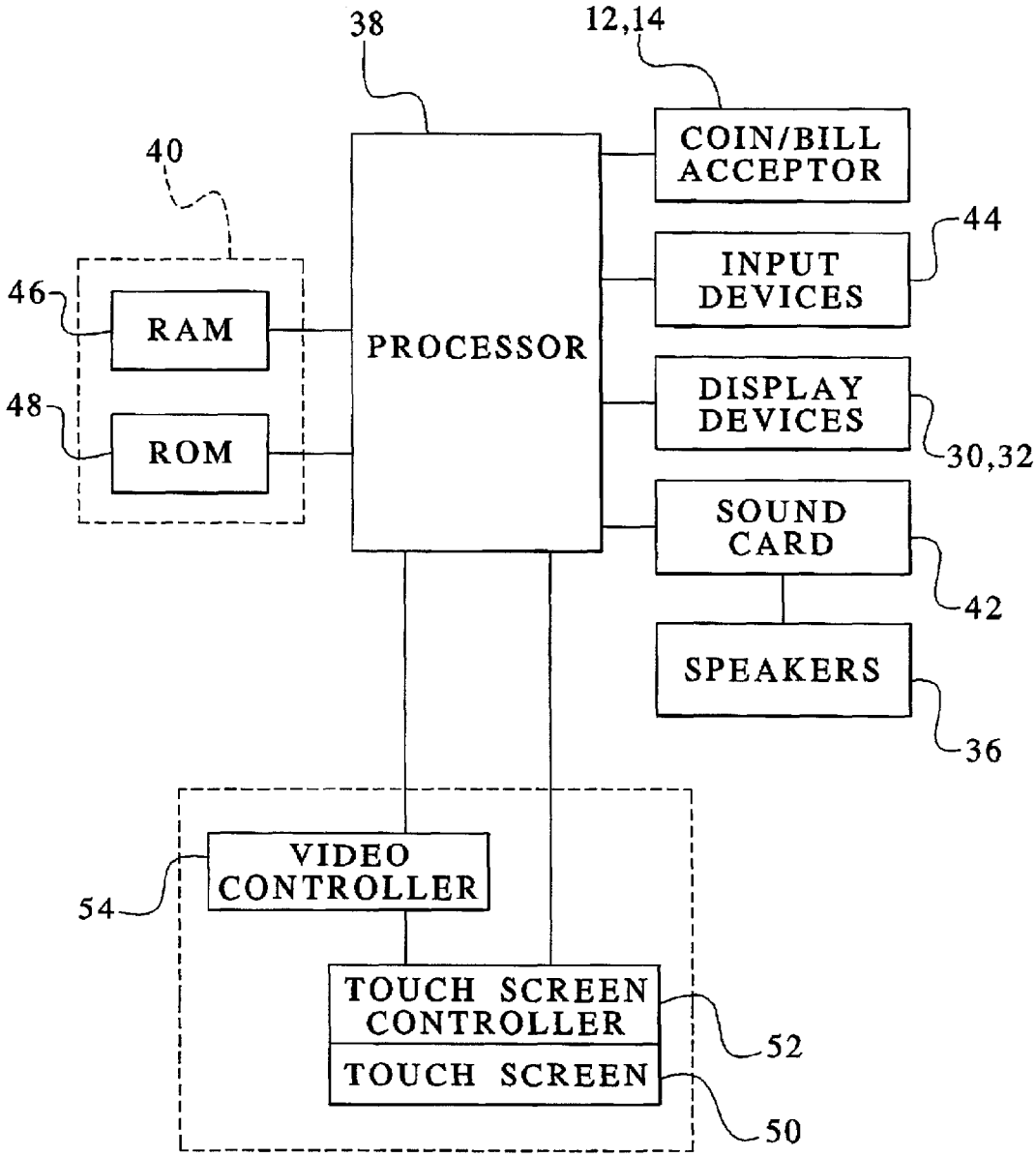
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. More than one processors may be employed in the present invention. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player may use the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively or individually referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the computer or controller.

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, the gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 may use a video-based central display device 30 to enable the player to play the bonus round. In one embodiment, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines displayed in a horizontal and/or diagonal fashion.

BONUS SCHEME

Referring generally to FIGS. 3A through 3H, one embodiment of the bonus scheme of the present invention provides a screen or display 100 which is preferably a touch screen, which enables the player to obtain or be provided an offer. In this embodiment, the gaming device provides a plurality of player selectable selections 102 to 150. The gaming device also includes a plurality of player picks of the selections. The plurality of picks may be pre-determined, randomly determined, based on the bonus triggering event, based on the player's wager or otherwise suitably determined. In an alternative embodiment, as described below, the plurality of picks is determined in a sub bonus game. The gaming device provides a plurality of offers. The gaming device randomly associates an offer with each player selection. The gaming device does not initially reveal or display the value of the offers, such as a credit or dollar amount, associated with each selection. In one embodiment, the number of offers in a pool of offers is equal to the number of selections. Thus, each offer will be associated with a different selection. In another embodiment, the number of offers which may be associated with the selection is greater than the number of selections. In this embodiment, after an offer is associated with a selection, the associated offer may not be associated with another selection during a particular bonus round.

In one embodiment, the gaming device randomly selects the offers from a pre-determined pool of offers. In another embodiment, the gaming device selects offers from multiple pre-determined pools of offers. In a further alternative embodiment, the gaming device randomly selects the offers from a pre-determined range of offer amounts. Other methods of determining the offer may be employed in conjunction with the present invention.

The gaming device enables the player to pick one selection for each pick provided to the player. After the player has picked a selection for each provided pick, the gaming device reveals the offer associated with the player's first picked selection. The most recent revealed offer is displayed in an offer display. The gaming device enables the player to use either an accept indicator or a reject indicator to either accept or reject the first revealed offer. If the player accepts the first revealed offer, the player obtains the first revealed offer and the bonus game terminates. If the player rejects the first revealed offer, the gaming device reveals the offer associated with the player's second picked selection. Each rejected revealed offer remains revealed and displayed for subsequent revealings of player picked selections. After a subsequent offer is revealed, the player may no longer obtain the previously rejected revealed offer.

The gaming device enables the player to use either the accept indicator or the reject indicator to either accept or reject the second revealed offer. If the player accepts the second revealed offer, the player obtains the second revealed offer and the bonus game terminates. If the player rejects the second revealed offer and the player has at least one non-revealed picked selection remaining, the gaming device reveals the offer associated with the player's next picked selection. If the gaming device has revealed all the player picked selections, the player obtains the second revealed offer and the bonus game terminates. It should thus be appreciated that the bonus game terminates when the player either accepts a revealed offer or the gaming device has revealed the offers associated with all the player picked selections. In the latter case, the player obtains the last revealed offer and the bonus game terminates.

In a preferred embodiment of the present invention, the gaming device will reveal the player picked selections in the order they were picked by the player. In an alternative embodiment of the present invention, the gaming device reveals the player picked selections in the reverse order that the played picked them. In another embodiment, the gaming device reveals the player picked selections in a random order. The gaming device could alternatively alter the order of the offers associated with the selections picked by the play. However, it should be appreciated that the gaming device reveals each player picked selection one at a time and enables the player to accept or reject the offer associated with each revealed selection.

In one embodiment of the present invention, after a revealed offer has been accepted, the gaming device reveals the offers associated with each non-revealed player picked selection. It should be appreciated that this feature provides increased entertainment by revealing to the player the offers the player would have been offered if the player had decided not to accept the last revealed offer. In an alternative embodiment, after a revealed offer has been accepted, the gaming device reveals the offers associated with all the player selectable selections. This embodiment also provides increased entertainment by revealing to the player the offers that the player may have potentially been offered if the player had picked different selections at the onset of the bonus game.

Figure 3A:
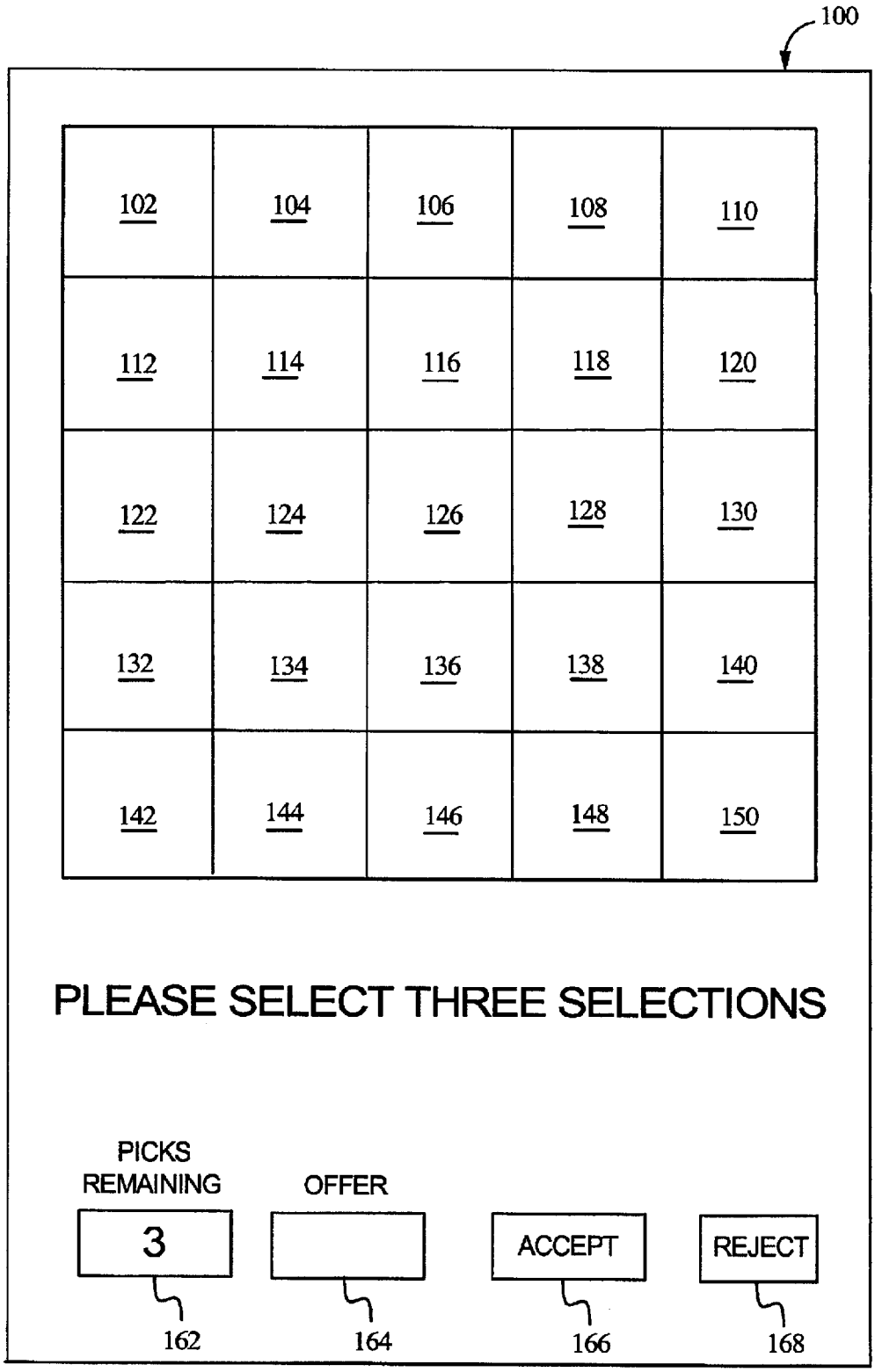
FIGS. 3A through 3H are front elevation views of an offer selection screen of one embodiment of the present invention, and illustrating an example of offers associated with player selectable selections being accepted or rejected.
Figure 3B:
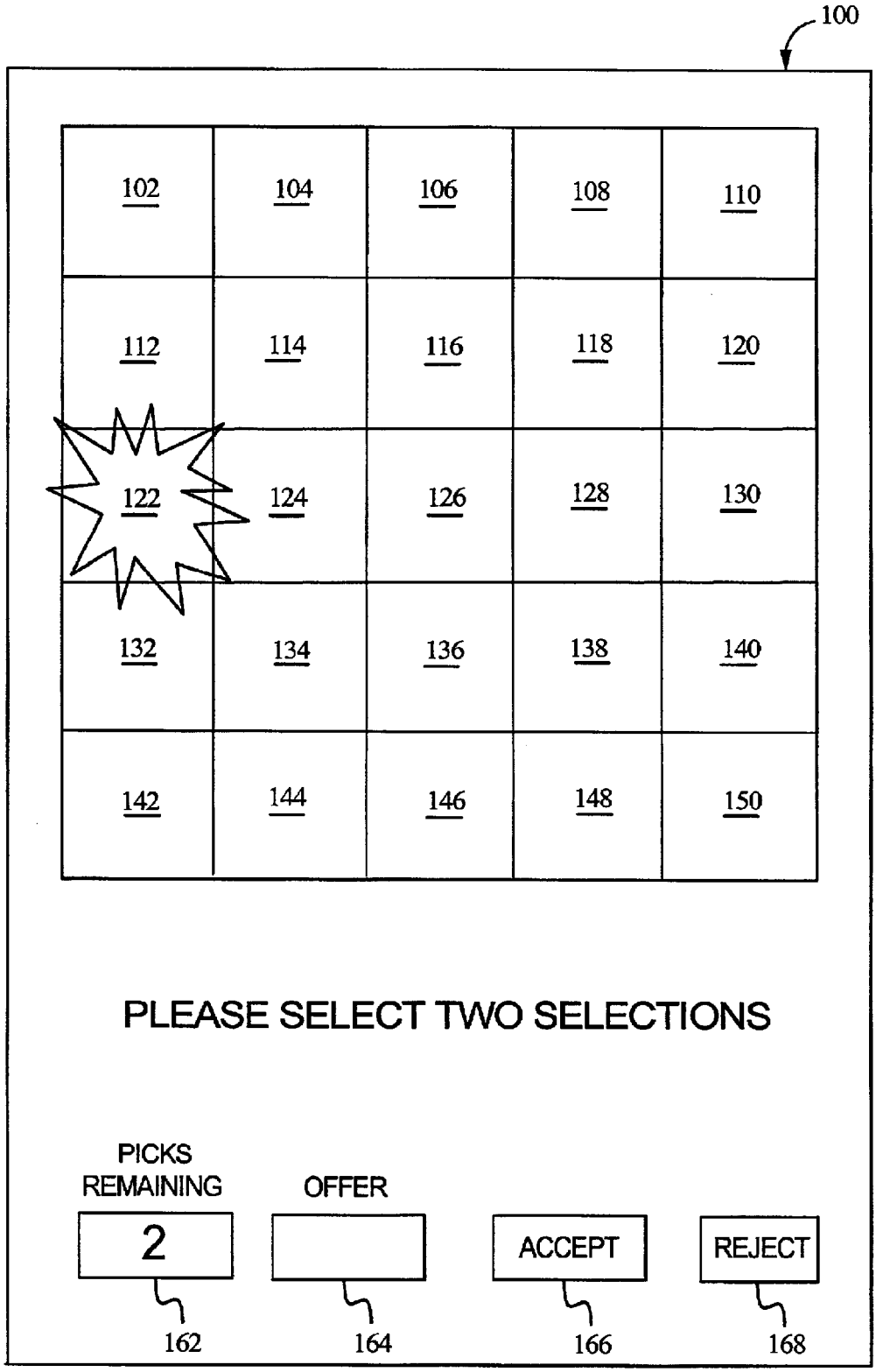
Figure 3C:
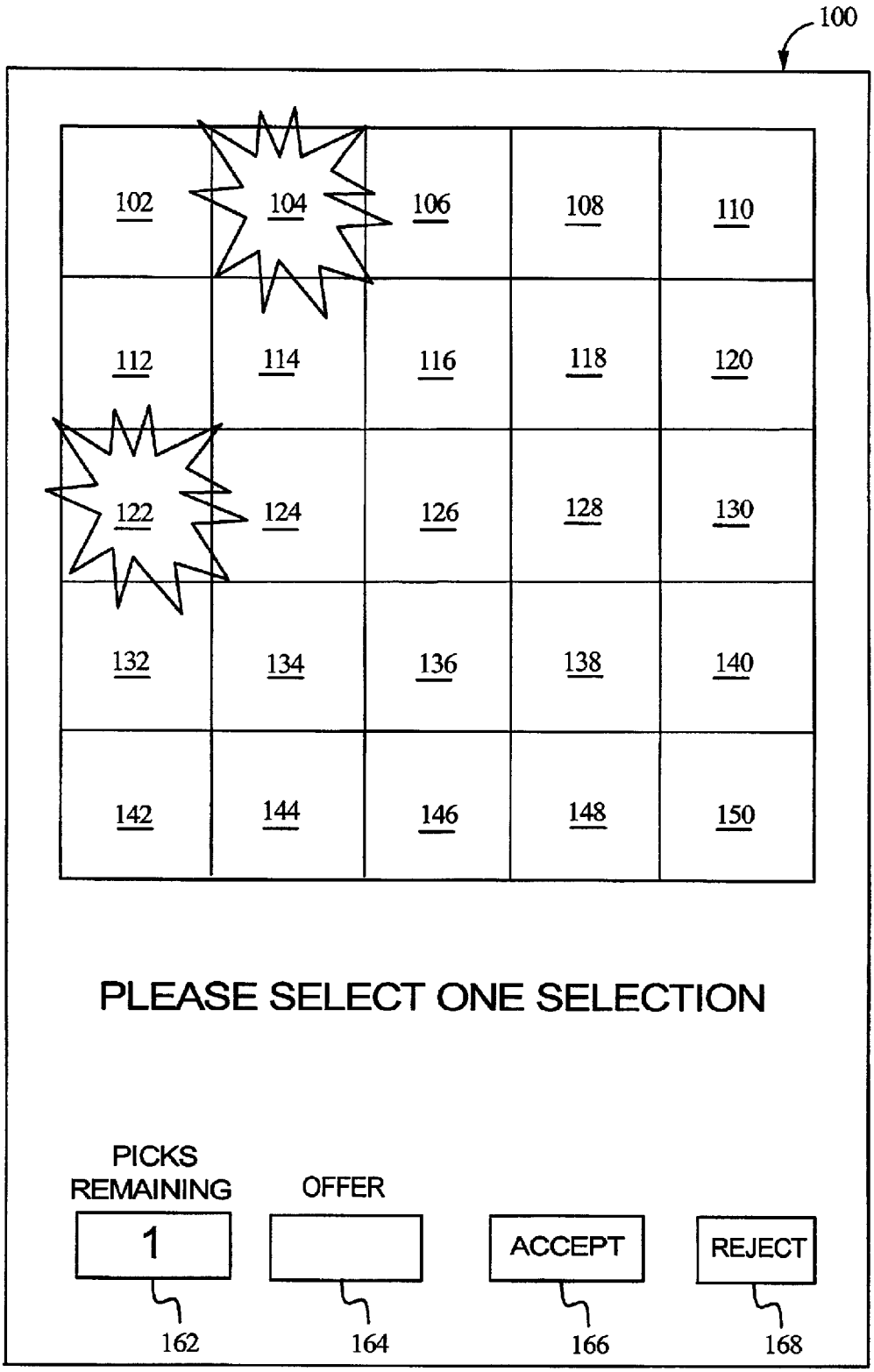
Figure 3D:
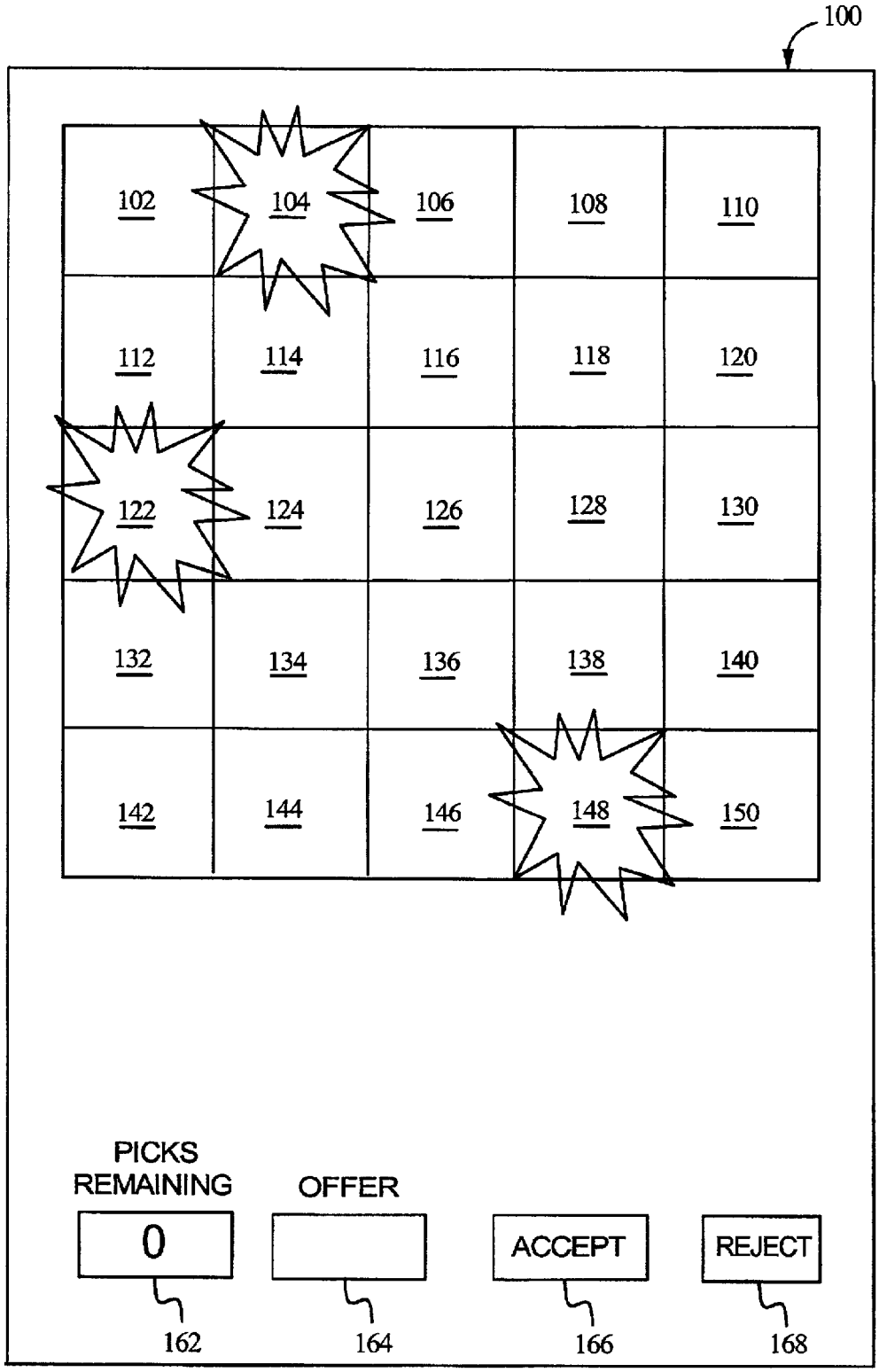

As shown in FIG. 3A, in one example of this embodiment of the present invention, there are 25 player selectable selections 102 through 150 each having an associated offer. The player picks one selection for each provided pick. In this case, the gaming device provided the player with three selection picks, as shown in the picks remaining display 162 in FIG. 3A. As illustrated in FIG. 3B, the player's first picked selection is selection 122 as indicated by the highlighted selection 122. For each selection the player picks, the number of picks is reduced by one as indicated in the picks remaining display 162. As seen in FIG. 3C, the players second picked selection is selection 104 as indicated by the highlighted selection 104. As seen in FIG. 3D, the player's final picked selection is selection 148 as indicated by highlighted selection 148. It should be appreciated that by selecting three selections, the player has determined the offers to be potentially offered to the player.

Figure 3E:
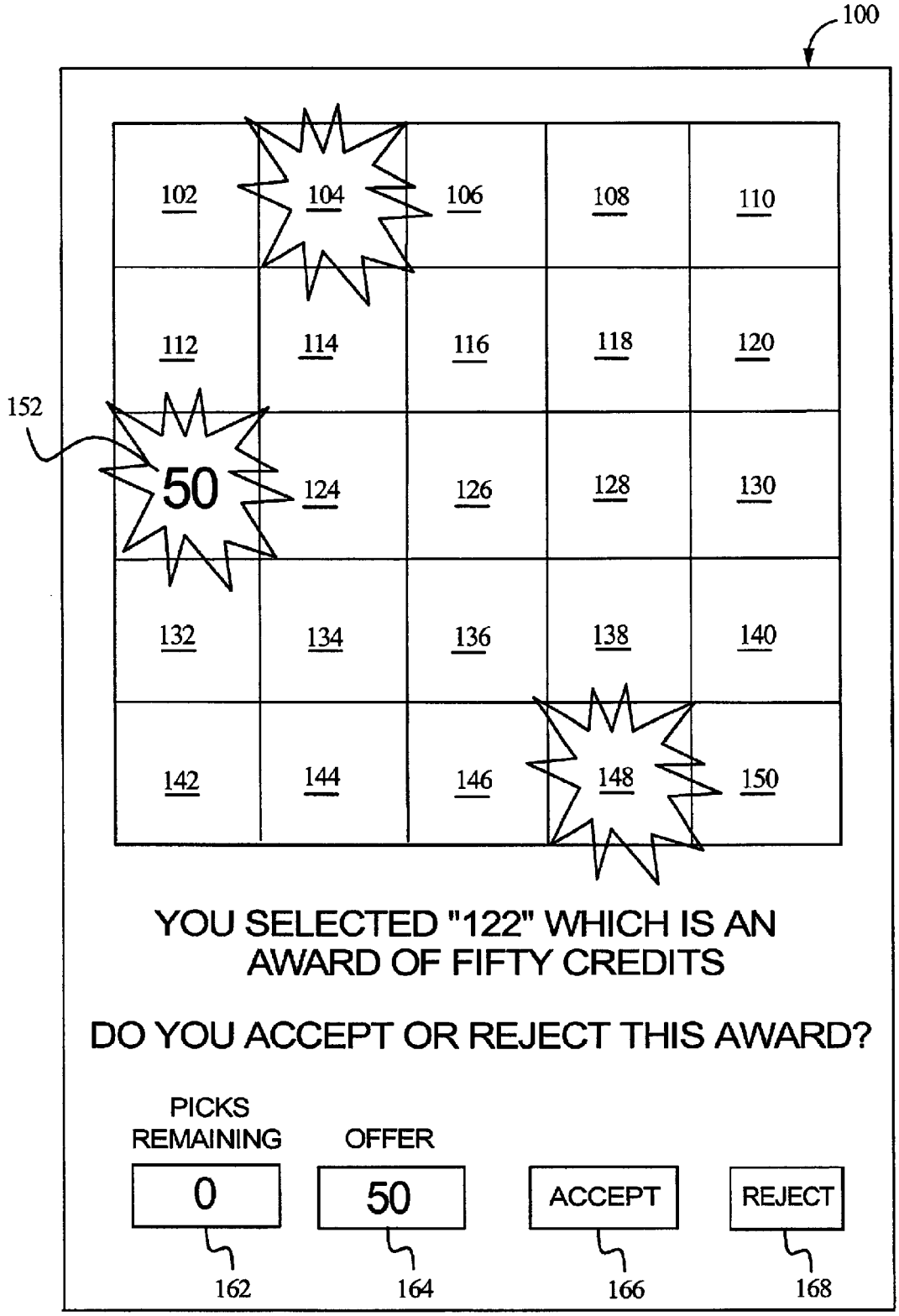

As illustrated in FIG. 3E, after the player has zero picks remaining 162, the gaming device reveals the offer associated with the player's first picked selection 122. In FIG. 3E, the gaming device reveals an offer of fifty credits 152 associated with the player's first picked selection. The offer amount of fifty is displayed in the offer display 164. Appropriate messages such as "YOU SELECTED 122 WHICH IS AN AWARD OF FIFTY CREDITS" and "DO YOU ACCEPT OR REJECT THIS AWARD?" are provided to the player visually or through suitable audio or audiovisual displays. In this case, using the reject indicator 168, the player rejected the first revealed offer. The rejected revealed offer of fifty credits 152 remains revealed and displayed for subsequent revealings of player picked selections. However, as shown in FIGS. 3F through 3G, as indicated by the dashed lines through selection 122, the rejected revealed offer may not be obtained by the player.

Figure 3F:
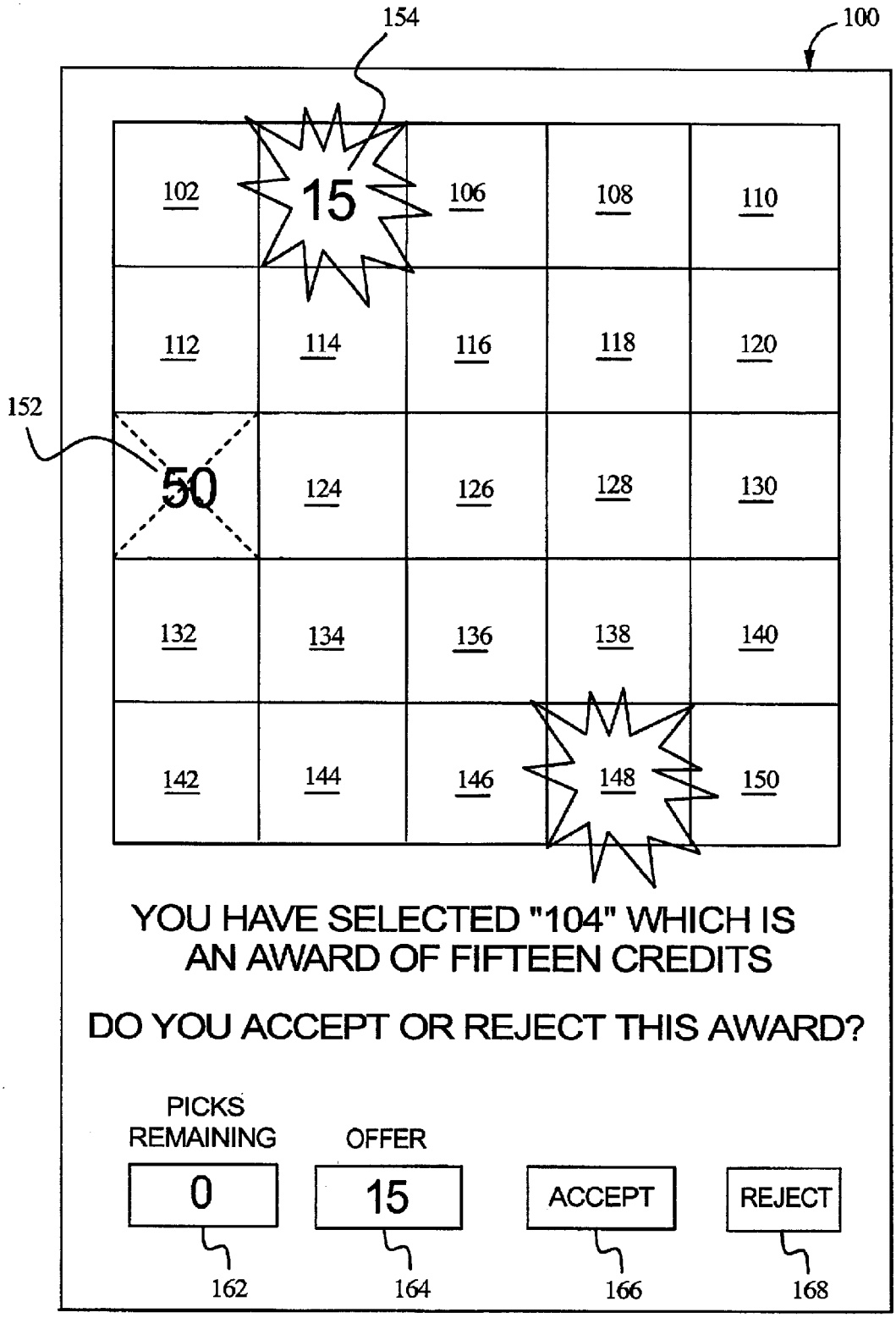

As shown in FIG. 3F, the gaming device revealed the offer associated with the player's second picked selection. In FIG. 3F, the gaming device reveals an offer of fifteen credits 154 associated with the player's second picked selection. The offer amount of fifteen is displayed in the offer display 164. Appropriate messages such as "YOU SELECTED 104 WHICH IS AN AWARD OF FIFTEEN CREDITS" and "DO YOU ACCEPT OR REJECT THIS AWARD?" are provided to the player visually or through suitable audio or audiovisual displays. In this case, using the accept indicator 166 the player accepted the second revealed offer and the player obtains an offer of fifteen credits. Appropriate messages such as "YOUR BONUS AWARD IS FIFTEEN CREDITS" are provided to the player visually or through suitable audio or audiovisual displays.

Figure 3G:
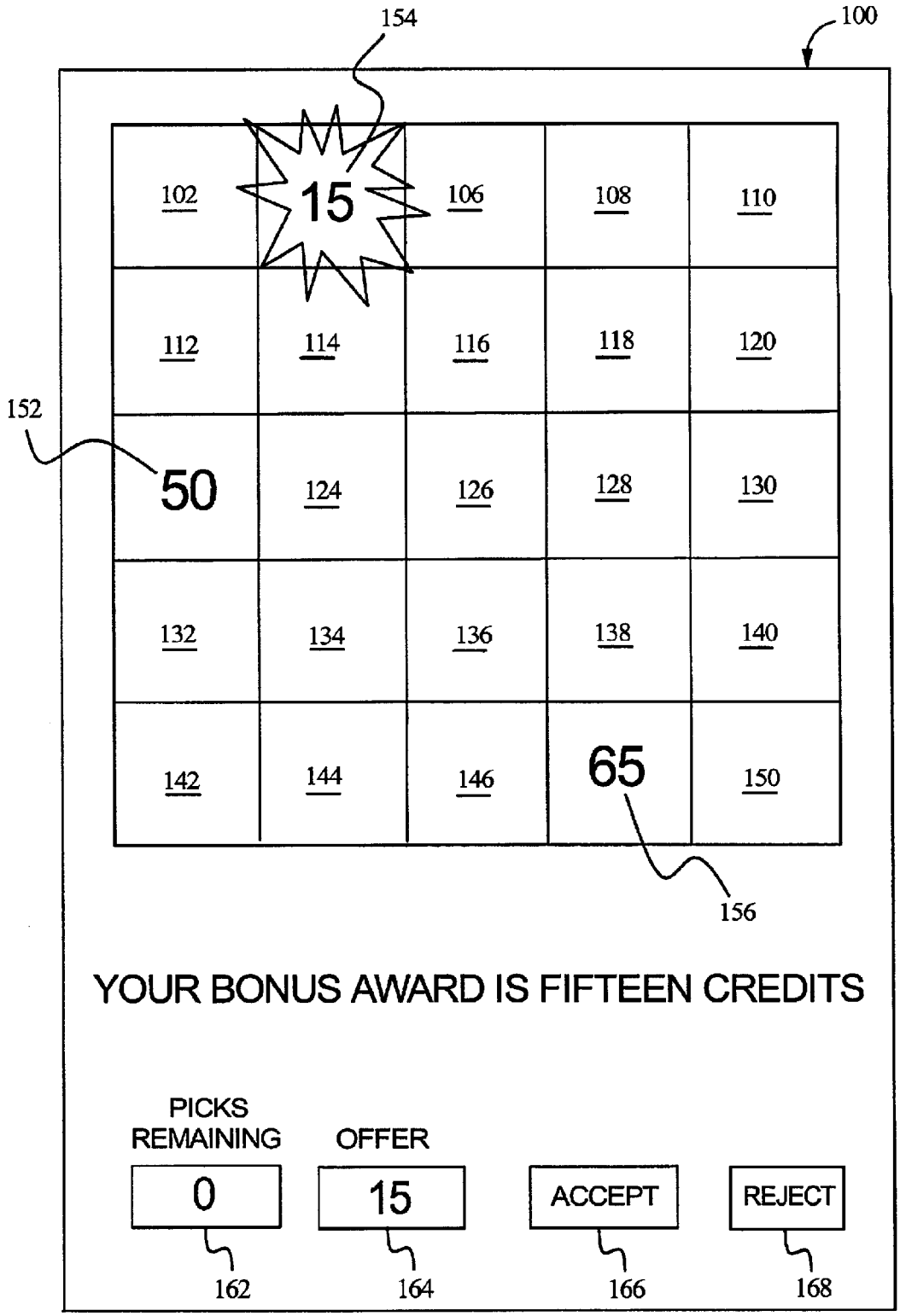
Figure 3H:
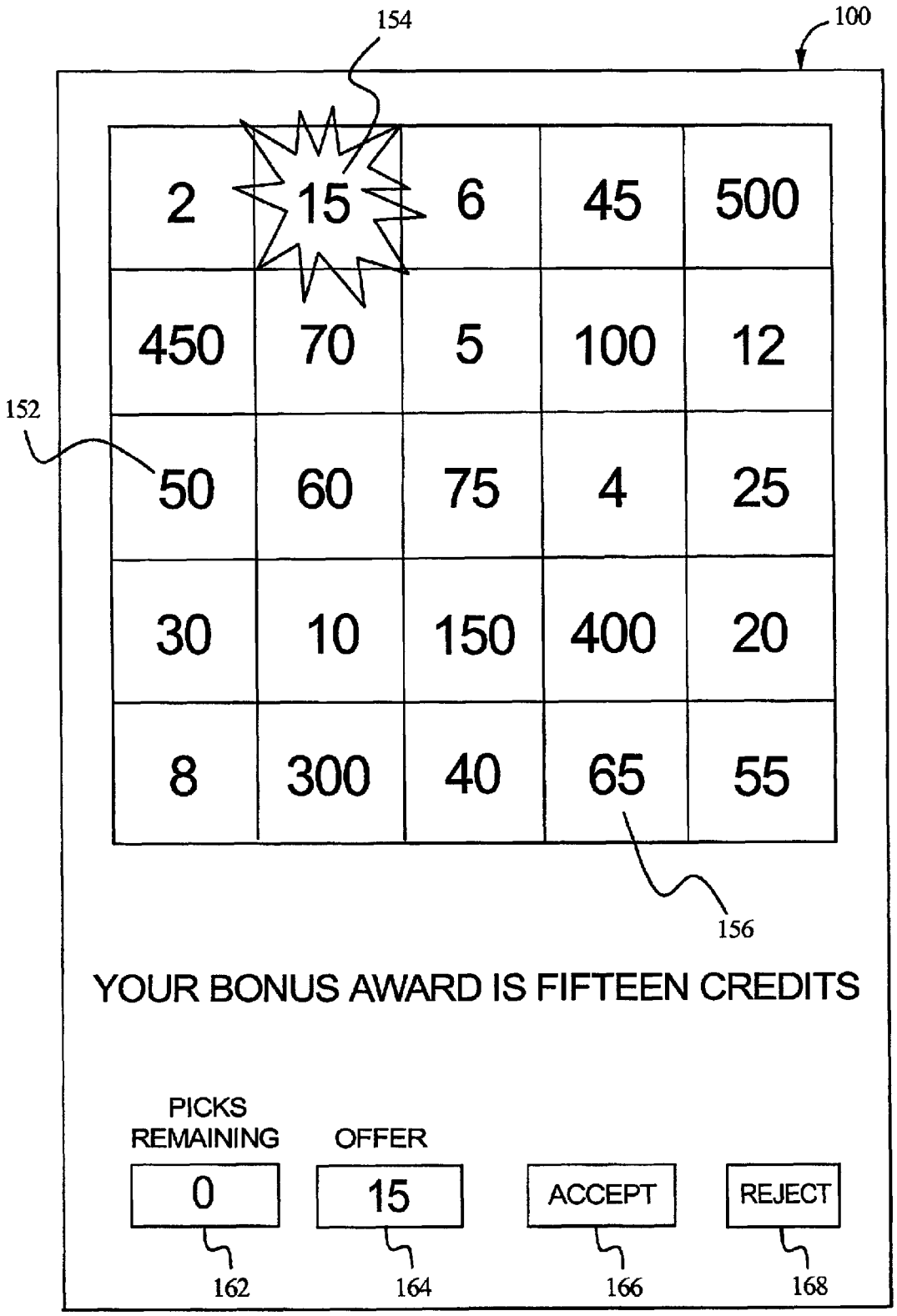

As illustrated in FIG. 3G, since the player accepted an offer with at least one non-revealed player picked selection remaining, the gaming device reveals the offer associated with the remaining non-revealed picked selections. In this case, the gaming device reveals the offer of sixty-five credits 156 associated with the remaining non-revealed picked selection 148. As seen in FIG. 3H, in an alternative embodiment of the present invention, the gaming device reveals the offer associated with all the player selectable selections.

It should be appreciated that the present invention enables a player to obtain an offer from a player picked subset of offers. Since each selection is associated with an offer from a pool of offers and the player's number of selection picks is less than the number of selections, the player picks a subset of offers to potentially be offered to the player. This feature provides increased player enjoyment by increasing the amount of control the player has in the outcome of the bonus game. Accordingly, as shown in FIGS. 3A through 3H, the player's picked subset of offers includes the offer amounts of fifty, fifteen and sixty-five credits. Thus, the player may see what the player could have "picked" with the player's selections. Thus, the offer made to the player (within the potential range of offers) are completely controlled by the players.

Referring generally to FIGS. 4A to 4D, in an alternative embodiment of the present invention, in addition to associating a plurality of offers with a plurality of selectable selections, the gaming device also associates a plurality of additional player picks with the plurality of selectable selections. It should be appreciated that there are less player picks than selections, and thus not all selections are associated with a player pick. The game proceeds as described above, with the gaming device enabling the player to pick one selection for each picked provided to the player. However, if the player picks a selection with an associated additional player pick, the gaming device reveals an additional player pick and enables the player to pick another selection. The offer associated with the additionally picked selection is combined with the offer associated with the original picked selection to form the player's modified offer. The combination of offers may be the sum of the two offers, the product of the two offers or based on any other suitable mathematical formula. It should be appreciated that in this embodiment, a player's offer may include the offers associated with at least two selections. If should be further appreciated that a selection may be associated with more than one additional player pick. In this case, the player picks one additional selection for each provided additional player pick. In an alternative embodiment, the gaming device may randomly pick the player's additional selections if the player's picked selections are associated with additional player picks.

Figure 4A:
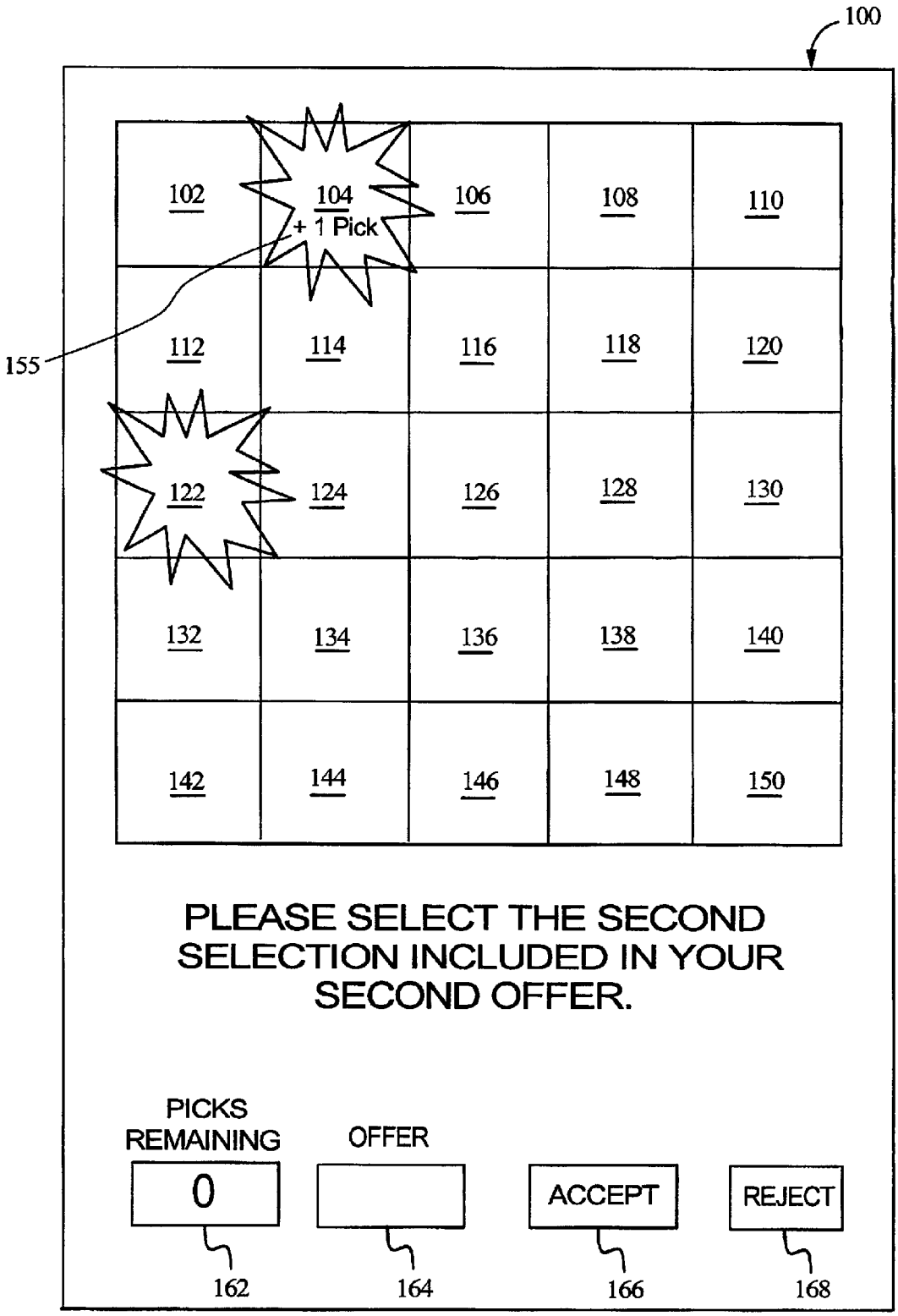
FIGS. 4A through 4D are front elevation views of an offer selection screen of one embodiment of the present invention, and illustrating an example of player picked selections associated with additional picks of player selectable selections.
Figure 4B:
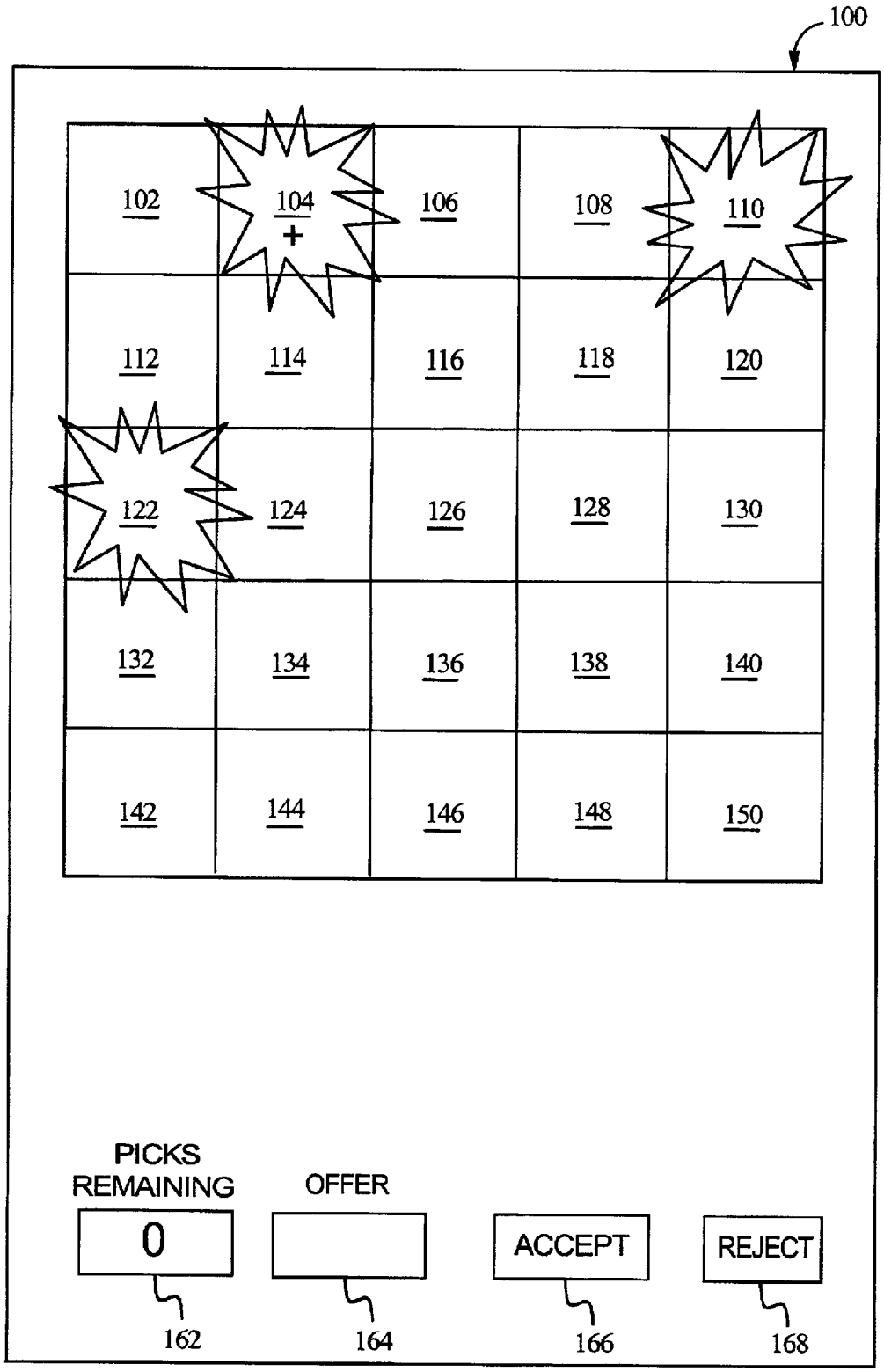

Referring now to FIG. 4A, the game is viewed in progress with the player having picked their second and final selection 104, as indicated by the highlighted selection 104. The second picked selection revealed one associated additional pick 155. Appropriate messages such as "PICK THE SECOND SELECTION INCLUDED IN YOUR SECOND OFFER" are provided to the player visually or through suitable audio or audiovisual displays. As seen in FIG. 4B, the player picked selection 110 with the player's additional pick, as indicated by highlighted selection 110.

Figure 4C:
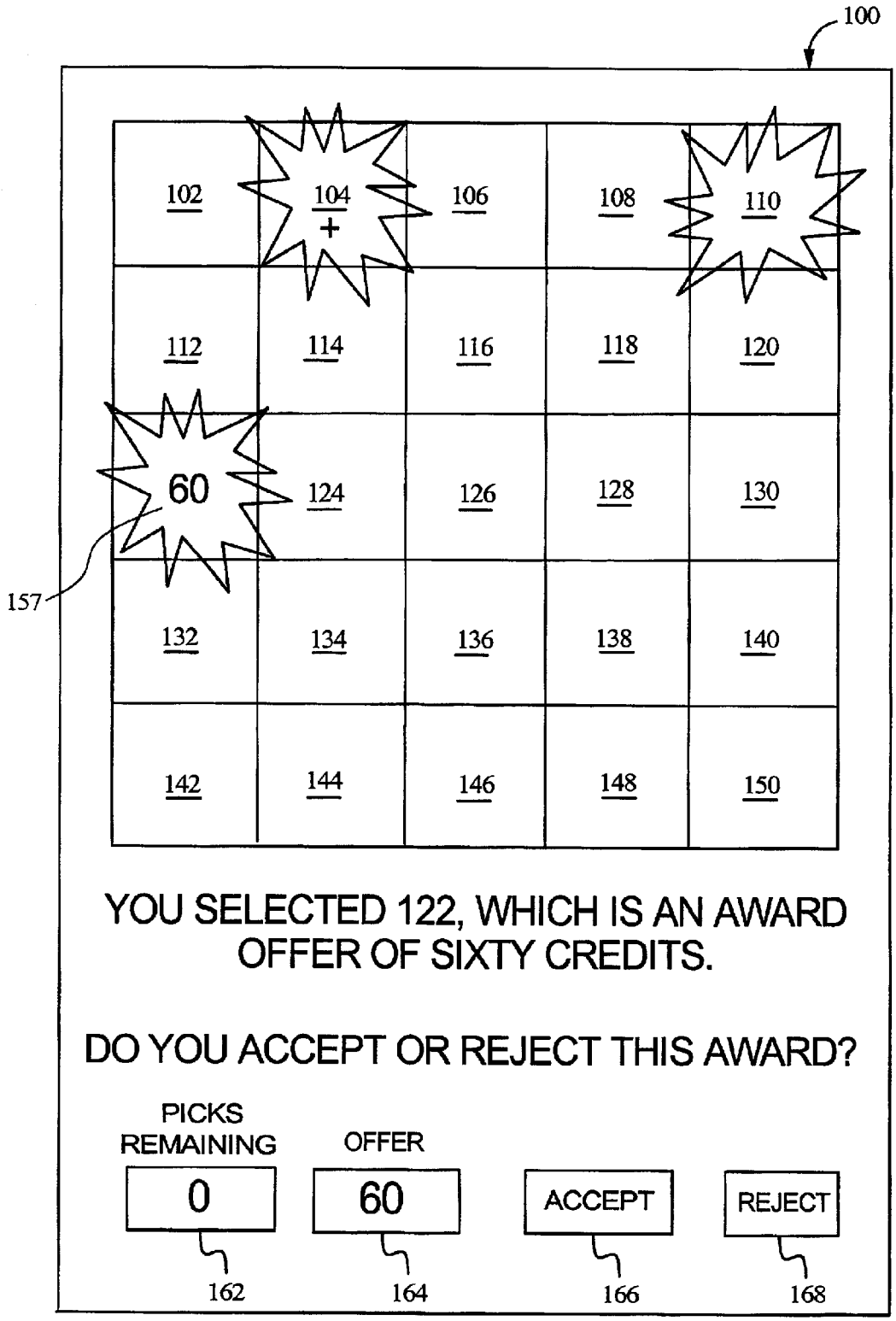

As illustrated in FIG. 4C, with zero picks remaining 162 the gaming device reveals the offer associated with the player's first picked selection 122. In FIG. 4C, the gaming device reveals an offer of sixty credits 157 associated with the player's first picked selection. The offer amount of sixty is displayed in the offer display 164. Appropriate messages such as "YOU SELECTED 122 WHICH IS AN OFFER OF SIXTY CREDITS" and "DO YOU ACCEPT OR REJECT THIS AWARD?" are provided to the player visually or through suitable audio or audiovisual displays. With a large award associated with the first picked selection, the player is faced with an interesting dilemma of accepting the offered award or rejecting this award and risking that their next offer, which the player knows will be a combination of two offers, will be a greater offer.

Figure 4D:
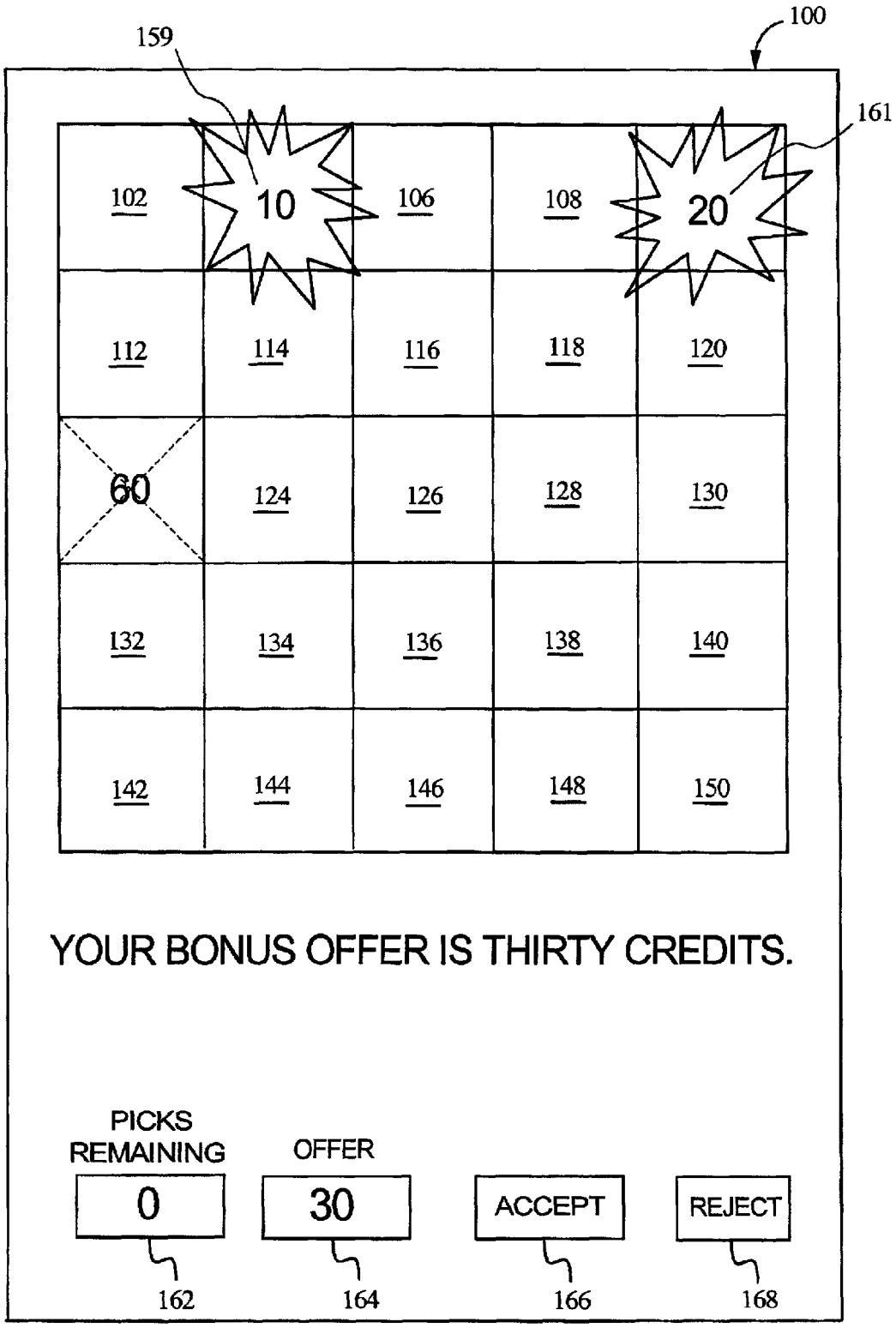

As seen in FIG. 4D, using the reject indicator 168, the player rejected the first revealed offer. The rejected offer of sixty credits 157 remains revealed and displayed for subsequent revealings of player picked selections. In FIG. 4D, the gaming device reveals the offers associated with the player's second picked selection and the player's additional selection. The gaming device reveals an offer of ten credits 159 associated with the player's second picked selection 104 and an offer of twenty credits 161 associated with the player's additional selection 110. The two offer amounts are combined to form the player's modified second offer and the offer amount of thirty credits is displayed in the offer display 164. With no picks remaining, the player obtains the modified offer of thirty credits and the bonus game ends. Appropriate messages such as "YOUR BONUS OFFER IS THIRTY CREDITS" are provided to the player visually or through suitable audio or audiovisual displays. It should be appreciated that in this case, the combination of the offers associated with the player's second picked selection and the player's additional selection (thirty credits) was less than the offer associated with the player's first picked selection (sixty credits). This feature provides increased entertainment because the combination of two or more offers may not always exceed the offer associated with a single selection. This provides an interesting game for the players.

Figure 5A:
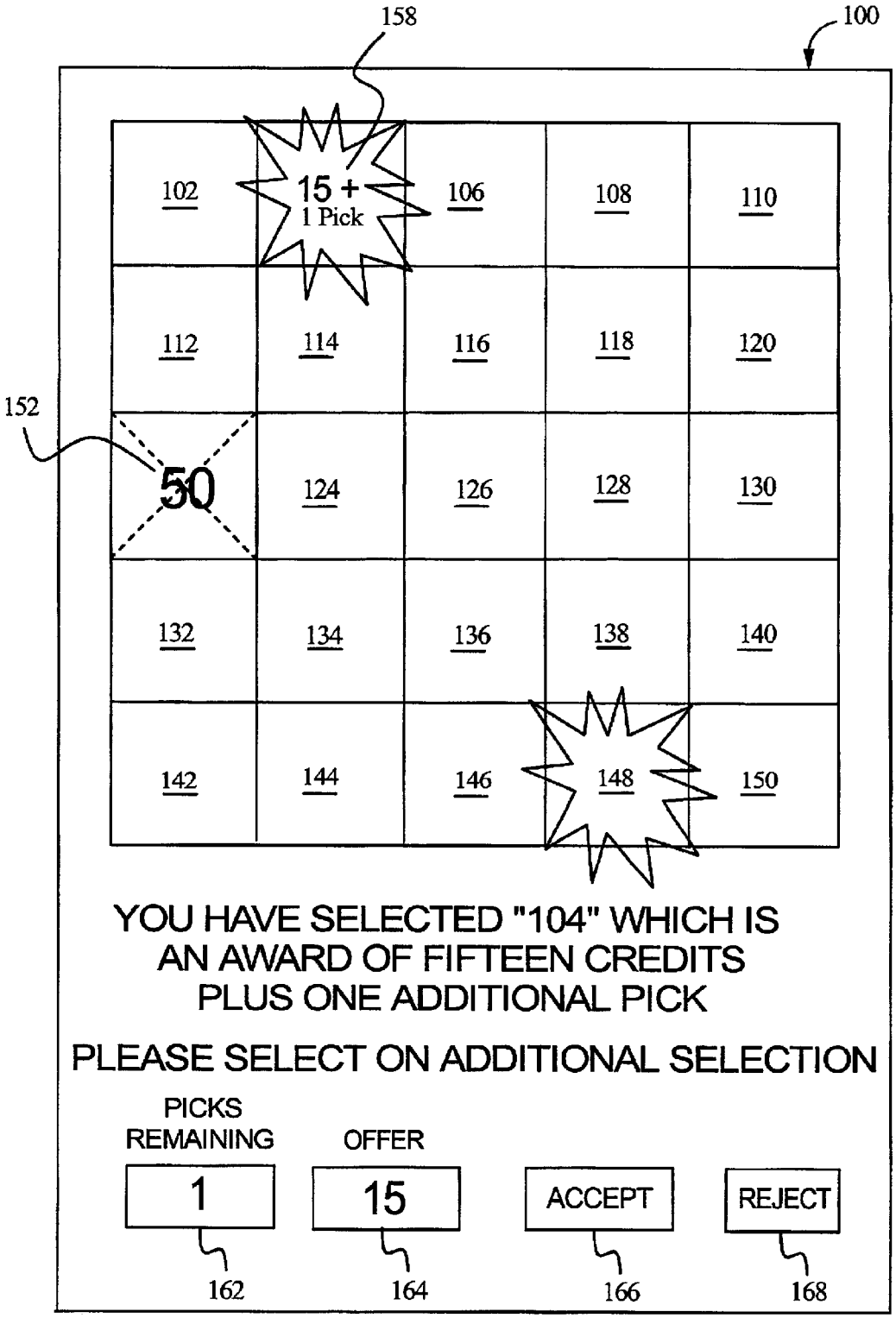
FIGS. 5A through 5C are front elevation views of an offer selection screen of one embodiment of the present invention, and illustrating an example of offers and additional picks associated with player selectable selections being accepted or rejected.
Figure 5B:
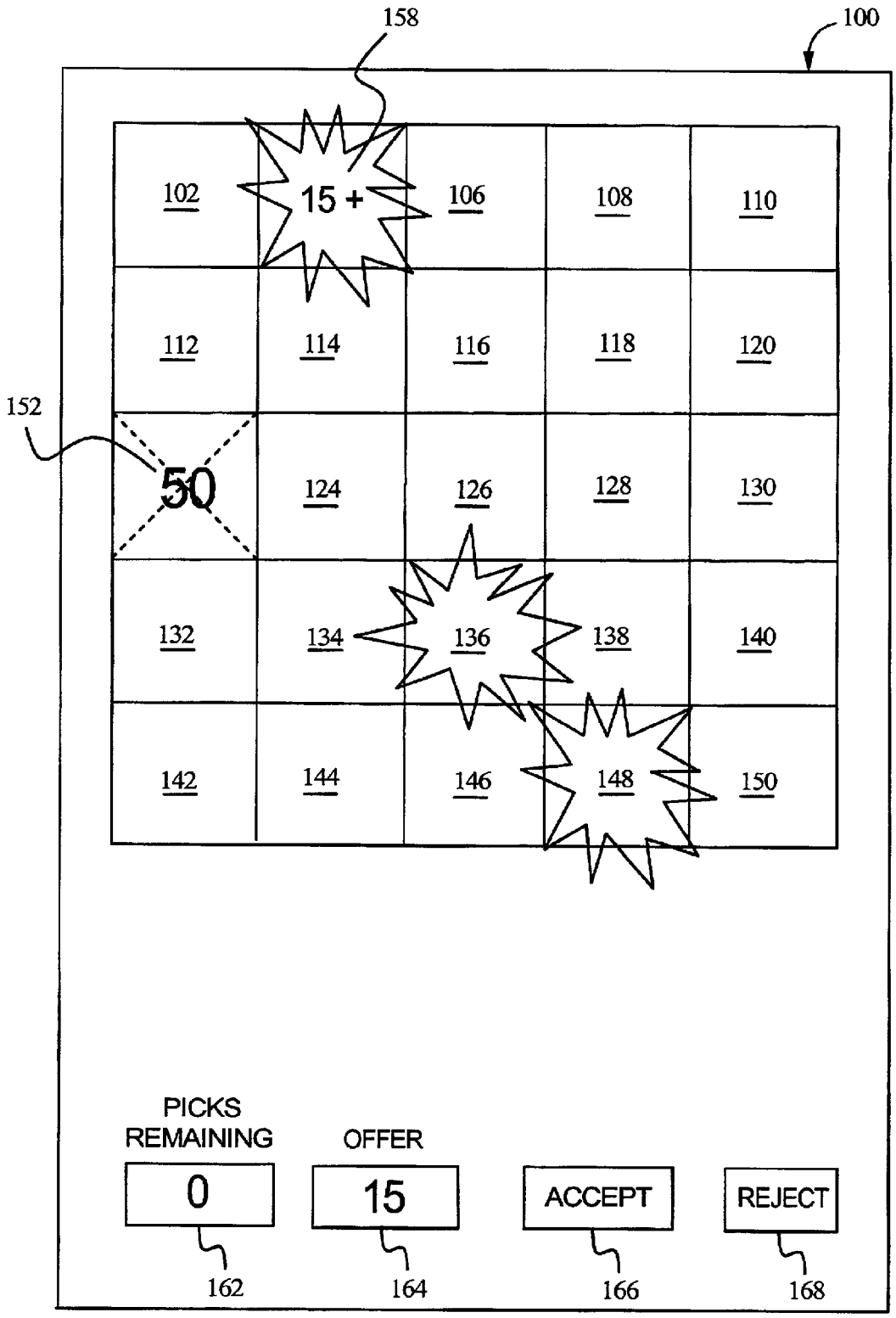
Figure 5C:
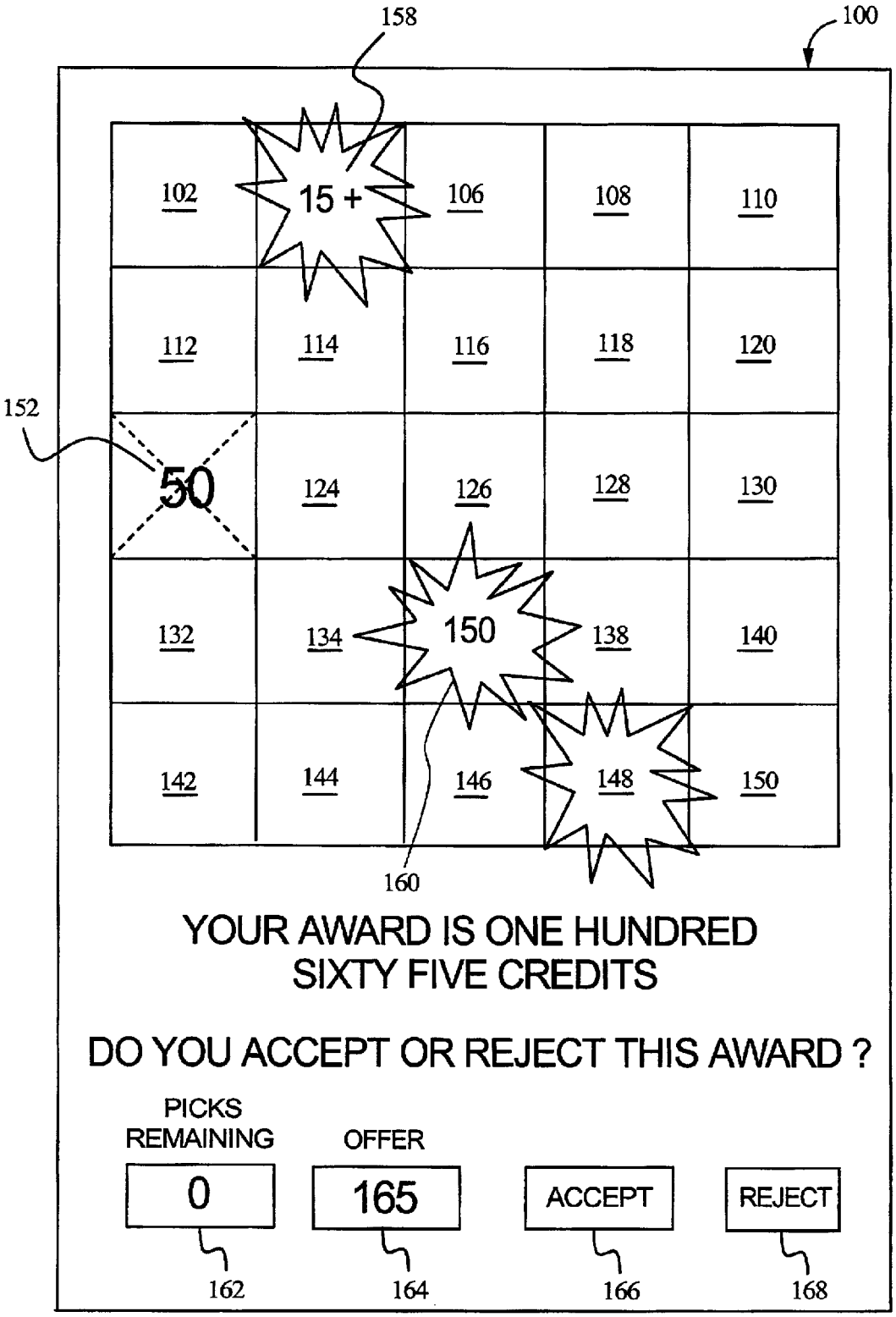

Referring generally to FIGS. 5A through 5C, in an alternative embodiment of the present invention, the gaming device does not reveal any additional pick associated with the player picked selection until after the offer associated with the picked selection is revealed. In this embodiment, the gaming device provides a plurality of additional picks which are randomly associated with a plurality of selectable selections. It should be appreciated that each selection remains associated with an offer, thus a plurality of selections are associated with both an offer and an additional pick. The game proceeds as described above, however, if the gaming device reveals both an offer and an additional pick associated with a player's picked selection, the gaming device enables the player to select an additional selection from the plurality of selections. The offer associated with the additional picked selection is combined with the offer associated with the original picked selection to form the players modified offer. It should be appreciated that the combination of offers may be the sum of the two offers, the product of the two offers or based on any other suitable mathematical formula. It should be further appreciated that if the additional picked selection is associated with both an offer and another additional pick, then the gaming device enables the player to select another additional selection. In this case, the modified offer would be a combination of the offer associated with the original player picked selection and the offers associated with all the additional picked selections. The gaming device enables the player to either accept or reject the modified offer. If the player accepts the modified offer, the player obtains the modified offer and the game terminates. If the player rejects the modified offer, the game proceeds as described above. In an alternative embodiment, the gaming device randomly picks another selection on the player's behalf when the player's picked selection is associated with an additional pick.

Referring now to FIG. 5A, the game is viewed in progress with the player's first offer already revealed by the gaming device and rejected by the player. As illustrated in FIG. 5A, the gaming device reveals the second player picked selection is associated with an offer of fifteen credits and one additional pick 158. The offer amount of fifteen is displayed in the offer display 164. The additional pick is displayed in the picks remaining display 162. Appropriate messages such as "YOU SELECTED 104 WHICH IS AN AWARD OF FIFTEEN CREDITS PLUS ONE ADDITIONAL PICK" and "PLEASE SELECT AN ADDITIONAL SELECTION" are provided to the player visually or through suitable audio or audiovisual displays. As seen in FIG. 5B, the player's additional selection is selection 136 as indicated by the highlighted selection 136. As seen in FIG. 5C, the gaming device reveals an offer of one hundred fifty credits associated with the players additional selection 160. This offer is combined with the offer of fifteen credits from the player's revealed second selection to form the modified offer of one hundred sixty five credits. The offer amount of one hundred sixty five is displayed in the offer display 164. Appropriate messages such as "YOUR AWARD IS ONE HUNDRED SIXTY FIVE CREDITS" and "DO YOU ACCEPT OR REJECT THIS AWARD?" are provided to the player visually or through suitable audio or audiovisual displays. In this case, using the accept indicator 166 the player accepted the modified offer and the player obtains an offer of one hundred sixty five credits.

Figure 6A:
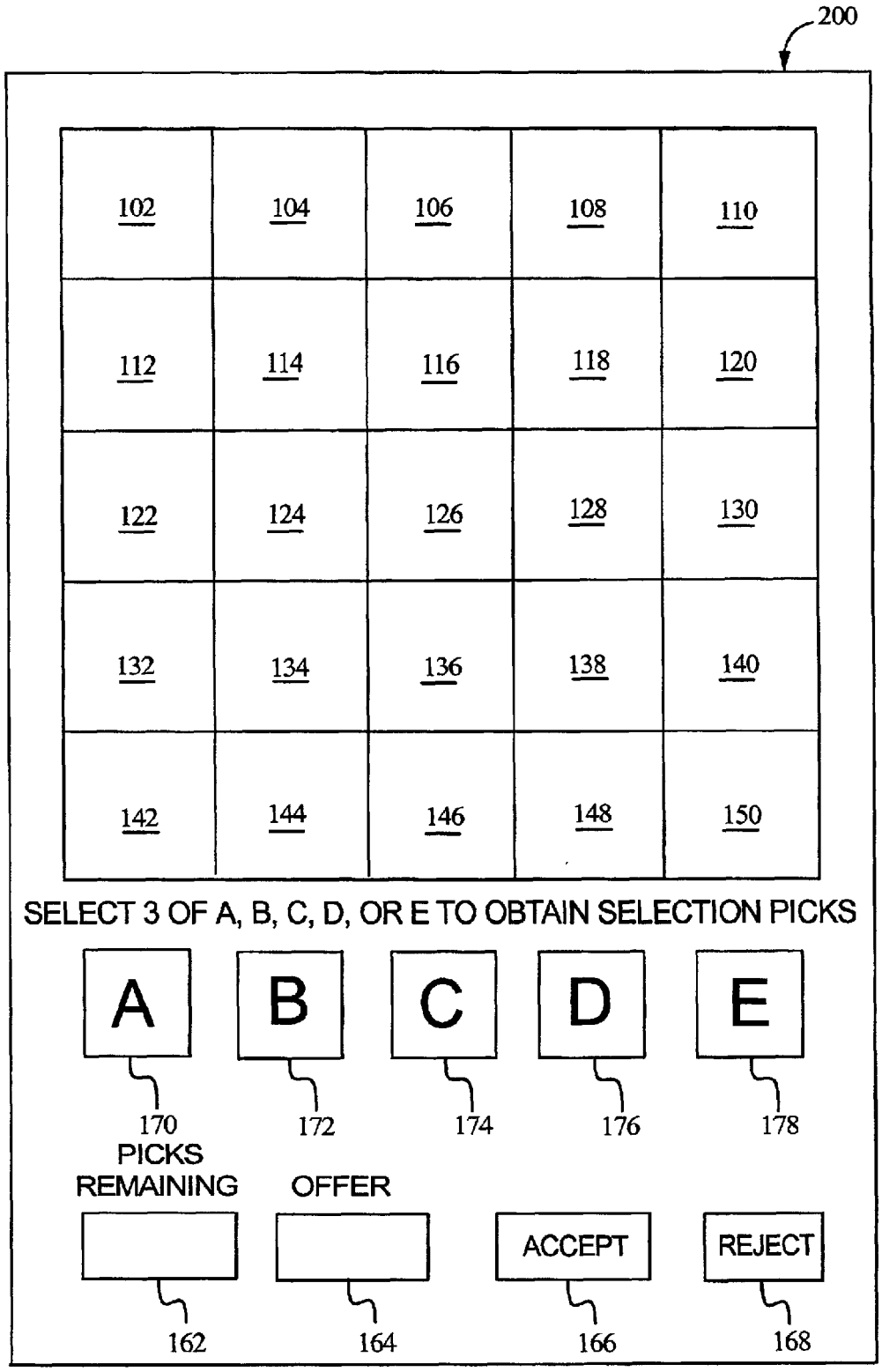
FIGS. 6A through 6C are front elevation views of the offer selection screen of one alternative embodiment of the present invention, and illustrating an example of a player obtaining picks of player selectable selections.
Figure 6B:
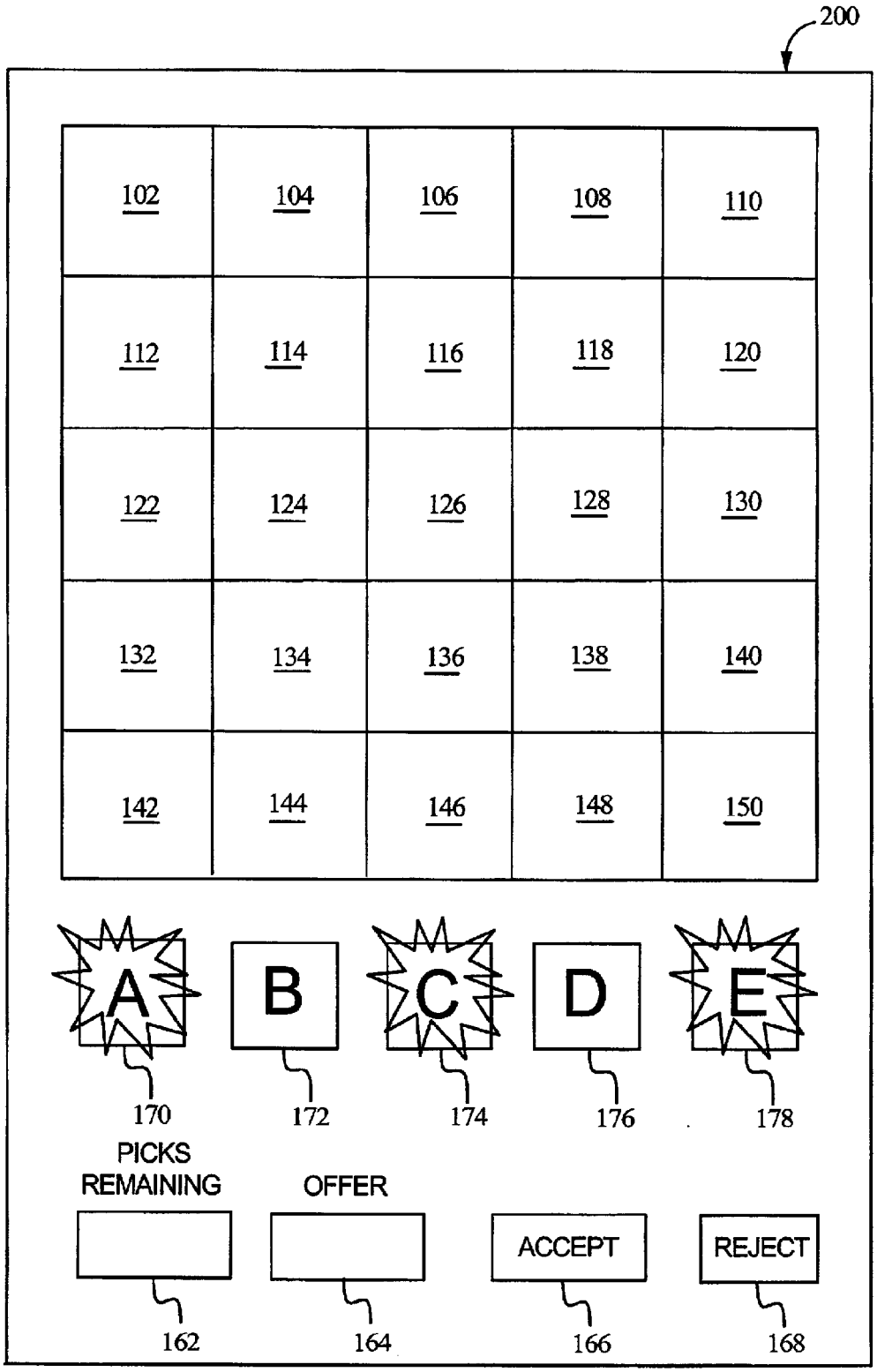
Figure 6C:
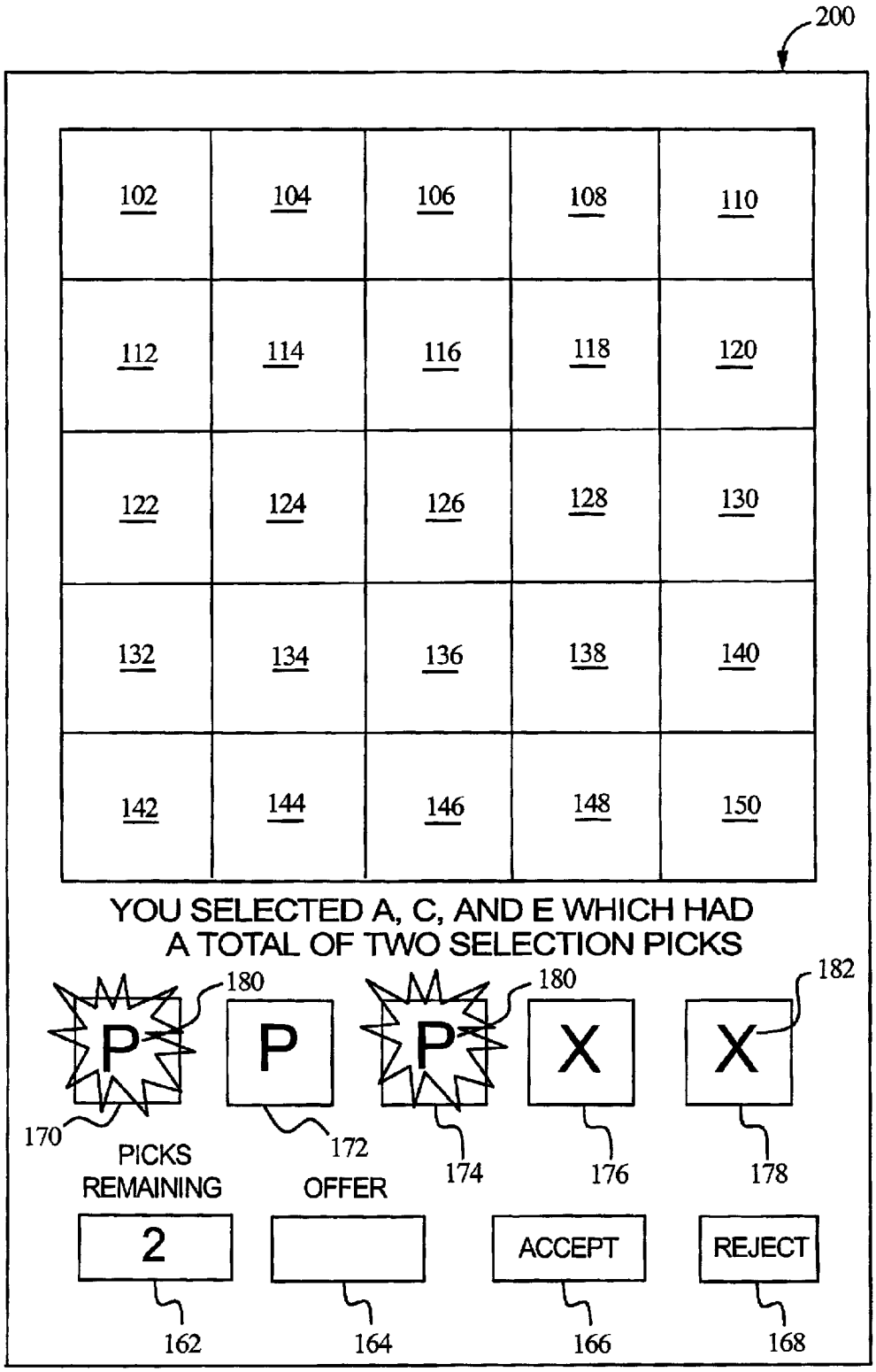

Referring generally to FIGS. 6A through 6C, in an alternative embodiment of the present invention, the gaming device provides a screen or display 200 which is preferably a touch screen, which enables the player to obtain a number of picks the player will have of the selectable selections as described in the above embodiments. In one embodiment, the gaming device provides a plurality of masked symbols. The gaming device provides a plurality of player picks of the selectable selections randomly associated with the plurality of masked symbols. In one embodiment, the number of player picks of the selectable selections is less than the number of masked symbols. In this embodiment, at least one masked symbol is not associated with a player selectable selection pick. In another embodiment, each masked symbol may be associated with a plurality of player picks of the selectable selections. In this embodiment, some masked symbols may have no associated player picks of the selectable selections, while other masked symbols may have a plurality of player picks of the selectable selections. The gaming device does not initially reveal if a player pick of a selectable selection is associated with each masked symbol. The gaming device also provides a plurality of player choices of the masked symbols. The number of provided player choices is less than the number of masked symbols. The number of player choices of the plurality of masked symbols may be predetermined, randomly determined, based on the bonus triggering event, based on the player's wager or otherwise suitably determined. The gaming device enables the player to choose a masked symbol for each choice provided to the player. The gaming device reveals if a player pick of a selectable selection is associated with each chosen masked symbol. The player obtains the number of picks of selectable selections associated with the revealed masked selections. In one embodiment, the gaming device reveals if a player pick of the selectable selections is associated with each non-chosen masked symbol. It should be appreciated that any method for determining the number of player picks of the selectable selections may be implemented into this invention.

Referring now to FIG. 6A, in one example of the present invention, there are five masked symbols 170, 172, 174, 176 and 178 labeled A, B, C, D and E, respectively. Each masked symbol may have a player pick of the selectable selections associated with it. The player is provided a number of choices, in this case three, to chose masked symbols. The player chooses a masked symbol for each provided player choice from choice A, choice B, choice C, choice D or choice E to acquire player picks of the selectable selections. After the player chooses a masked symbols for each provided player choice, as indicated by highlighted selections 170, 174 and 178 in FIG. 6B, the gaming device reveals if any player picks of the selectable selections are associated with the chosen masked symbols. In FIG. 6B, the player choose masked symbols A, C and E. Symbols A and C each had one associated player pick of the selectable selections 180. Symbol E had no associated player picks of the selectable selections 182. Accordingly, as revealed in FIG. 6C, the player obtained a total of two picks of the selectable selections to be utilized as described in the above embodiment. The gaming device provides the player with a display of the number of acquired player picks of selectable selections 162. Appropriate messages such as "SELECT A, B, C, D OR E TO OBTAIN SELECTION PICKS" and "YOU SELECTED A, C AND E WHICH HAD A TOTAL OF TWO SELECTION PICKS" are preferably provided to the player visually or through suitable audio or audiovisual displays. In an alternative embodiment, after the player's chosen masked symbols are revealed, as illustrated in FIG. 6C, the gaming device reveals if the non-chosen masked symbols had any associated player picks of the selectable selections.

It should be appreciated that by allowing the player to select a plurality of selections, each with an associated offer, the present invention provides the player control over which offers will even be potentially offered to the player. Furthermore, as described in the alternative embodiment pertaining to the subgame, the player has control over the number of offers which may potentially be made to the player. The additional control of determining both the pool of offers to potentially be made and the number of offers in that pool, coupled with the players control over whether to accept or reject each selected offer, provides increased enjoyment and entertainment to the player of the current invention.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a plurality of player selectable selections;

a plurality of offers adapted to be associated with said selections;

at least one display device for displaying the selections and offers to a player;

a number of player picks of said selections;

at least one additional player pick of said selections; and a processor in communication with said display device and programmed to:

(a) randomly associate the offers with said selections, wherein at least one designated selection is associated with one of said offers and said additional player pick, (b) enable the player to sequentially select each of said number of player picks of said selections before displaying any of the offers associated with the selections, (c) enable the player to pick at least one additional selection if the designated selection is selected, wherein the additional selection is picked before the offer associated with the designated selection is displayed, (d) sequentially display each offer associated with each selection picked by the player to the player and enable the player to sequentially accept or reject each displayed offer until the player accepts the displayed offer or until the offers associated with all of the selections picked by the player are displayed to the player, and (e) provide the player the displayed offer which is accepted by the player or if no displayed offer is accepted by the player, provide the player the last displayed offer.

2. The gaming device of claim 1, wherein said plurality of offers are randomly selected from at least one pool of offers.

3. The gaming device of claim 1, wherein said plurality of offers are randomly selected from a pre-determined range of offer amounts.

4. The gaming device of claim 1, wherein said number of player picks is randomly determined.

5. The gaming device of claim 1, wherein said number of player picks is pre-determined.

6. The gaming device of claim 1, wherein the processor is programmed to reveal the offers associated with the selections picked by the player and not displayed to the player after providing an accepted offer to the player.

7. The gaming device of claim 1, wherein the processor is programmed to reveal the offers associated with the selections not picked by the player after the player accepts an offer or the last offer is provided to the player.

8. The gaming device of claim 1, wherein the offers associated with each picked selection are sequentially displayed in the order picked by the player.

9. The gaming device of claim 1, wherein the offers associated with each picked selection are sequentially displayed in reverse of the order picked by the player.

10. The gaming device of claim 1, wherein the offers associated with each picked selection are displayed in a random order.

11. The gaming device of claim 1, wherein at least one displayed offer includes offers associated with at least two selections.

12. The gaming device of claim 11, wherein the offer associated with the designated selection and the offer associated with player's additional picked selection are combined as the displayed offer associated with the designated selection.

13. The gaming device of claim 1, which includes means for determining the number of player picks of said selections.

14. The gaming device of claim 13, wherein the determining means includes a plurality of player selectable masked symbols and a plurality of player picks associated with said masked selections, wherein the number of player picks of said selections is at least in part based on the picks associated with one of said masked selections picked by the player.

15. The gaming device of claim 14, wherein a plurality of picks of the selections are associated with each masked symbol.

16. The gaming device of claim 14, wherein the plurality of picks of the selections are randomly associated with the plurality of masked symbols.

17. A gaming device having a game comprising:

a plurality of player selectable selections;

plurality of offers associated with said selections;

at least one additional player pick associated with a designated one of said selections;

an offer acceptor;

an offer rejector;

a processor which controls the offer acceptor and offer rejector; and an award provided to a player after: (a) the player sequentially picks each of a plurality of said selections wherein said selections are picked before any of the offers associated with the selections are revealed; (b) the processor enables the player to pick at least one additional selection if the designated selection is picked, wherein the additional selection is picked before the offer associated with the designated selection is displayed and (c) the processor sequentially reveals the offer associated with each selection picked by the player and enables the player to sequentially accept or reject each revealed offer using one of the offer acceptor and offer rejector until the player accepts the revealed offer or until the offers associated with the selections picked by the player are revealed to the player, wherein the award is based on the offer accepted by the player or the last revealed offer.

18. The gaming device of claim 17, wherein said plurality of offers are randomly selected from at least one pool of offers.

19. The gaming device of claim 17, wherein said plurality of offers are randomly selected from a pre-determined range of offer amounts.

20. The gaming device of claim 17, wherein an amount of said plurality of player picks is pre-determined.

21. The gaming device of claim 17, wherein after the player accepts an offer, the processor reveals the offers associated with the selections picked by the player and not previously displayed to the player.

22. The gaming device of claim 17, wherein the processor reveals the offers associated with the selections not picked by the player after the player accepts an offer, or the last offer picked by the player is revealed to the player.

23. The gaming device of claim 17, wherein the offers associated with each picked selection are sequentially displayed in the order picked by the player.

24. The gaming device of claim 17, wherein the offers associated with each picked selection are sequentially displayed in a reverse of the order picked by the player.

25. The gaming device of claim 17, wherein the offers associated with each picked selection are displayed in a random order.

26. The gaming device of claim 17, which includes means for determining the number of player picks of said selections.

27. The gaming device of claim 26, wherein the means includes a plurality of player selectable masked symbols and a plurality of player picks associated with said masked selections, wherein the number of player picks of said selections is at least in part based on the picks associated with one of said masked selections picked by the player.

28. A gaming device comprising:

a plurality of player selectable selections;

a plurality of offers associated with said plurality of selections;

a number of player picks of said selections;

an additional player pick associated with a designated one of said selections;

a modified offer which includes a combination of the offers associated with at least two selections;

an offer acceptor;

an offer rejector;

a processor which controls the offer acceptor and offer rejector; and an award provided to a player after: (a) the player sequentially picks each of a plurality of said selections based on the number of player picks, wherein the selections are picked before any of the offers associated the selections are revealed, and wherein if said designated selection is picked, the processor enables the player to pick an additional selection before said offer associated with said designated selection is revealed and combines said offer associated with said additional picked selection with said offer associated with the designated selection to form said modified offer; and (b) the processor sequentially reveals the offer or modified offer associated with each player picked selection and enables the player to sequentially accept or reject each said offer or modified offer using one of the offer acceptor and offer rejector until the player accepts the offer or modified offer or until the offers or modified offer associated with all of the player picked selections are revealed to the player, wherein the award is based on the offer or modified offer accepted by the player or the last revealed offer or modified offer.

29. The gaming device of claim 28, wherein a plurality of additional player picks are associated with the first designated selection.

30. The gaming device of claim 29, wherein the modified offer includes at least one of the offers associated with selections picked by the player after the designated selection is picked by the player.

31. The gaming device of claim 29, wherein the processor picks at least one of said additional player picks.

32. The gaming device of claim 28, which includes means for determining the number of player picks of said selections.

33. A gaming device comprising:

a plurality of player selectable selections;

a plurality of offers associated with a plurality of said selections;

a number of player picks of said selections;

an additional player pick associated with a designated said selections;

a modified offer which includes a combination of the offers associated with at least two of the selections;

an offer acceptor;

an offer rejector;

a processor which controls the offer acceptor and offer rejector; and an award provided to a player after: (a) the player sequentially picks each of a plurality of said selections based on the number of player picks wherein the selections are picked before any of the offers associated with the selections are revealed and wherein if the player picks said designated selection, the processor enables the player to pick an additional selection before said offer associated with said designated selection is revealed and combines said offer associated with said selection with said offer associated with the designated selection to form said modified offer; (b) the processor sequentially reveals the offer or modified offer associated with each selection; (c) the processor enables the player to sequentially accept or reject each revealed offer or modified offer using one of the offer acceptor and offer rejector until the player accepts one of the revealed offers or the modified offer or until the offers associated with all of the selections picked by the player are revealed to the player, wherein the award is based on the offer or modified offer accepted by the player or the last revealed offer.

34. The gaming device of claim 33, wherein the means includes a plurality of player selectable masked symbols and a plurality of player picks associated with said masked selections, wherein the number of player picks of said selections is at least in part based on the picks associated with one of said masked selections picked by the player.

35. The gaming device of claim 33, wherein a plurality of additional player picks are associated with the designated selection.

36. The gaming device of claim 35, wherein the modified offer includes at least one of the offers associated with selections picked by the player after the designated selection is picked by the player.

37. The gaming device of claim 33, wherein said processor picks at least one additional player pick.

38. The gaming device of claim 33, which includes means for determining the number of player picks of said selections.

39. A gaming device comprising:

a plurality of player selectable selections;

a plurality of offers associated with said selections;

at least one changed offer selection included in said selections, wherein said offer associated with said changed offer selection is a combination of the offers associated with at least two selections;

a number of original player picks of said selections;

an additional player pick of said selections associated with said changed offer selection;

at least one display device for displaying the selections and offers to a player; and a processor in communication with said display device and programmed to:

(a) enable the player to sequentially select each of said number of original player picks of said selections before displaying any of the offers associated with the selected selections, (b) reveal said additional player pick, if the player picks said changed offer selection, (c) before said offer associated with said changed offer selection is revealed, enable the player to select an additional selection for each revealed player pick, if any, (d) combine the offer associated with the changed offer selection and the offer associated with the additional picked selection, if any, to form the offer associated with the changed offer selection, (e) sequentially display each offer associated with each original selection picked by the player, (f) enable the player to sequentially accept or reject each displayed offer until the player accepts the displayed offer or until the offers associated with all of the selections picked by the player are displayed to the player, and (g) provide the player the displayed offer which is accepted by the player or if no displayed offer is accepted by the player, provide the player the last displayed offer.

40. A method of operating a game of a gaming device, said method comprising the steps of:

(a) triggering the game;

(b) randomly associating a plurality of offers with a plurality of player selectable selections, wherein at least a designated one of said selections is associated with one of said offers and at least one additional player pick;

(c) displaying said plurality of selections;

(d) enabling a player to sequentially pick each of a plurality of the selections before revealing any of the offers associated with the picked selections;

(e) enabling the player to pick at least one additional selection if the designated selection is selected, wherein the additional selection is picked before the offer associated with the designated selection is revealed, (f) revealing the offer associated with one of the selections picked by the player;

(g) enabling the player to accept or reject said revealed offer;

(h) repeating steps (f) through (g) if said player rejects said revealed offer and the offer associated with at least one player picked selection has not been revealed;

(i) revealing the offer associated with a last selection picked by the player if said player rejects said previous revealed offers; (j) providing the player the revealed offer accepted by the player or providing the player said last offer revealed; and (k) terminating the game.

41. The gaming device of claim 40, wherein the means includes a plurality of player selectable masked symbols and a plurality of player picks associated with said masked selections, wherein the number of player picks of said selections is at least in part based on the picks associated with one of said masked selections picked by the player.

42. The method of claim 40, wherein the plurality of player picks of said selections is pre-determined, randomly determined, determined in a sub-game, or determined in a prior game.

43. The method of claim 40, wherein the offers associated with each picked selection are sequentially displayed in the order picked by the player, are sequentially displayed in a reverse of the order picked by the player, or displayed in a random order.

44. The method of claim 40, wherein the game is provided to a player through a data network.

45. The method of claim 44, wherein the data network is an internet.

46. The method of claim 40, which includes the steps of:

associating a plurality of player picks of selections with a plurality of masked symbols;

displaying said plurality of masked symbols; and enabling a player to pick at least one of said masked symbols to determine the number of player picks of the selections.

47. A method of operating a game of a gaming device, said method comprising the steps of:

(a) triggering the game;

(b) randomly associating a plurality of offers and at least one additional player pick with a plurality of player selectable selections;

(c) displaying said plurality of selections;

(d) enabling a player to sequentially pick each of a plurality of the selections before revealing any of the offers associated with the selections;

(e) if any additional pick is associated with one of said player picked selections, enabling said player to pick at least one additional selection before revealing any of the offers associated with the selections;

(f) sequentially revealing the offers associated with the player picked selections;

(g) enabling the player to sequentially accept or reject each said revealed offer;

(h) revealing the offer associated with a last selection picked by the player if said player rejects said previous revealed offers;

(i) providing the player the offer accepted by the player or providing the player said last offer revealed; and (j) terminating the game.

48. The method of claim 47, wherein the offers associated with each picked selection are sequentially displayed in the order picked by the player, are sequentially displayed in a reverse of the order picked by the player, or displayed in a random order.

* * * * *